US006563398B1

(12) United States Patent
Wu

(10) Patent No.: US 6,563,398 B1
(45) Date of Patent: May 13, 2003

(54) LOW PROFILE WAVEGUIDE NETWORK FOR ANTENNA ARRAY

(75) Inventor: Chen Wu, Hamilton (CA)

(73) Assignee: Litva Antenna Enterprises Inc., Hamilton (CA)

( * ) Notice: Subject to any disclaimer, the term of this patent is extended or adjusted under 35 U.S.C. 154(b) by 0 days.

(21) Appl. No.: 09/471,262

(22) Filed: Dec. 23, 1999

(51) Int. Cl.[7] ..... H01P 5/12
(52) U.S. Cl. ..... 333/137; 343/776; 343/771
(58) Field of Search ..... 333/125, 137, 333/248; 343/776, 777, 778, 771

(56) References Cited

U.S. PATENT DOCUMENTS

| | | | | |
|---|---|---|---|---|
| 5,243,357 A | | 9/1993 | Koike et al. | 343/776 |
| 5,291,650 A | * | 3/1994 | Carvalho et al. | 333/248 X |
| 5,568,160 A | | 10/1996 | Collins | 343/778 |
| 6,034,647 A | * | 3/2000 | Paul et al. | 343/776 |

FOREIGN PATENT DOCUMENTS

| | | | |
|---|---|---|---|
| EP | 320675 A2 | 6/1989 | H01Q/25/02 |

OTHER PUBLICATIONS

Sehm, T., Lehto, A., Raisanen, A., "A Large Planar 39–GHz Antenna Array of Waveguide–Fed Horns", IEEE Transactions on Antennas and Propagation, 46(8), 1998, pp. 1189–1193.

* cited by examiner

*Primary Examiner*—Benny T. Lee
(74) *Attorney, Agent, or Firm*—Bereskin & Parr

(57) ABSTRACT

A waveguide network has a first port and a plurality of second ports connected to a two dimensional rectangular array of antenna elements. The second ports and antenna elements are oriented in a fixed direction. The waveguide network includes at least three successive sets of junctions and bends including a first set connected to the first port and a last set connected to the second ports. The junctions and bends in each set are all E-plane junctions and E-plane bends or are all H-plane junctions and H-plane bends, and successive sets alternate between a set of E-plane junctions and E-plane bends and a set of H-plane junctions and H-plane bends. The bends in at least one set lead in the fixed direction, and the bends in at least one other set, not including the last set, lead in a direction opposite to the first direction. Preferably, the waveguide bends in each set, other than the first set and possibly the last set, lead in a direction opposite to the bends in the previous set. The waveguide network is conveniently assembled from one piece containing all of the E-plane junctions and E-plane bends and another containing all of the H-plane junctions and H-plane bends.

20 Claims, 18 Drawing Sheets

LOW PROFILE WAVEGUIDE NETWORK FOR ANTENNA ARRAY

FIELD OF THE INVENTION

The present invention relates to the field of antennas and wireless communication of electromagnetic radiation. In particular, the present invention relates to a waveguide network for connecting to a flat panel array of antenna elements.

BACKGROUND OF THE INVENTION

Antennas are generally passive devices which radiate or receive electromagnetic radiation, and an antenna's receiving properties can be derived from its transmitting characteristic or vice versa. The antenna is connected to a transmission line which carries an electrical signal that is transformed into electromagnetic radiation (in a transmitting antenna) or transformed from electromagnetic radiation (in a receiving antenna). An antenna design ideally meets desired criteria for gain, polarization, performance, bandwidth requirements, and other criteria while maintaining size, profile, and weight at a minimum. Furthermore, the antenna should be simple, inexpensive, and easy to manufacture.

Parabolic reflector antennas are highly directional (high gain) antennas that include a parabolic reflector to provide directional characteristics. For this reason, many point-to-point communication systems currently use parabolic reflector antennas. However, even though parabolic antennas typically provide for good wide band communication, they are much larger and thicker than flat panel or planar antenna structures. The bulky and unstable structure of parabolic antennas is also susceptible to high winds and other deleterious effects that may cause the antenna to fall or collapse. While stabilizing support may be provided for the antenna structure, this leads to additional costs and space requirements.

As a result, the use of much more compact planar or flat panel integrated antenna arrays has steadily increased over the past few years in the microwave frequency band, and the popularity of such flat panel antennas is similarly expected to rise in millimeter wave communication. Slot antenna elements fed by a printed transmission line such as a microstrip line, can provide a low overall profile or thickness (as described, for example, in applicant's U.S. patent application No. 09/316,942, now U.S. Pat. No. 6,317,094, issued on Nov. 13, 2001). However, printed antenna feed structures exhibit a relatively low gain.

A slotted waveguide linear array can be formed by placing a number of suitably oriented slot antenna elements periodically along a waveguide transmission line. The antenna elements may take different forms, such as tapered slot antenna elements. The slots radiate power from the incident waveguide mode that may then be reflected by a terminal short circuit to create a narrow-band resonant array. Alternatively, if the residue of the incident wave is absorbed by an impedance matched load, then the array generates a broadband travelling wave. Waveguide fed slot arrays provide much better antenna efficiency and gain than printed antenna arrays, because waveguides exhibit much lower transmission loss than printed transmission lines. However, a drawback associated with prior art waveguide feed networks, for example that disclosed in U.S. Pat. No. 4,952,894, is that the overall array size is typically larger, particularly in terms of the thickness or profile of the array.

In addition, because waveguide networks typically have a larger size or profile than printed transmission lines, it may be difficult to use a waveguide network in an array in which the antenna elements are tightly spaced. Furthermore, many antenna designs are required to exhibit a wide band characteristic. While a waveguide network can be designed to provide wide-band operation, a waveguide network with carefully designed bends and junctions is required to avoid undesirable band-limiting effects. These design restraints may result in additional manufacturing expense and complexities.

For example, U.S. Pat. No. 5,243,357 to Koike et al. discloses a square waveguide network for a receiving antenna array capable of separating both horizontal and vertical polarization components. To reduce the bulky profile of the waveguide network, the inventors describe a non-corporate feed waveguide network which can be made relatively flat and of low profile by providing a difference of one half the inter-waveguide wavelength between the length of the waveguide section connecting an antenna element to a first input branch of a waveguide junction and the length of the waveguide section connecting an adjacent antenna element to a second input branch of the waveguide junction. As a result, the waves at the first and second input branches of the waveguide junction have opposite polarizations (i.e opposite phase), and the resulting wave in a third output branch of the junction is the sum of the two (instead of the difference). In this manner, the waveguide network can be arranged so that it has bends in only a single plane, avoiding the large profiles associated with most prior art waveguide networks when the number of antenna elements increase. However, although it exhibits a low profile, proper operation of this embodiment of the waveguide network of Koike et al. is heavily dependent on the length of waveguide sections relative to the inter-waveguide wavelength in order to provide accurate summing of waveguide components. Consequently, the instantaneous bandwidth of the network is very small, and it is not suitable for wide band applications in which the wavelength inside the waveguide varies significantly. Furthermore, because this waveguide network effectively bends only in a single plane, and because it requires a difference of one half the inter-waveguide wavelength between two adjacent antenna elements, the network of Koike et al. may not be capable of feeding tightly spaced antenna elements and also consumes a greater footprint (i.e. the length and width of the network) than a waveguide network that bends in two planes.

Thus, there is a need for a waveguide network for feeding an array of slot antenna elements that is compact, has a low profile, exhibits a good wide band characteristic, and is optimized for high volume and low cost manufacturing.

SUMMARY OF THE INVENTION

It is an object of the invention to provide an improved waveguide network.

In a first aspect, the present invention provides a waveguide network having a first port; a plurality of second ports oriented in a first direction; and a plurality of waveguide junctions and waveguide bends. Each junction has a common branch and two separate branches. Each bend has a first branch and a second branch meeting at an angle, the junctions and bends being grouped into a plurality of sets with a particular set being denoted by n, n being an integer ranging from 0 to (N-1) and N representing the total number of sets and being an integer greater than or equal to three. The 0'th set is a first set, and the n'th set has $2^n$ junctions and $2^{n+1}$ corresponding bends. Each of the separate branches of each junction in a particular set is connected to a first branch of a bend in the same set. The plurality of sets comprise E-plane sets operatively coupled with H-plane sets in an alternating fashion, each E-plane set comprising E-plane junctions and E-plane bends, and each H-plane set comprising H-plane junctions and H-plane bends. The common branch of the junction in the first set is connected to the first port. The second branch of each of the bends in the n'th set, other than the last set, is connected to the common branch of a junction in the (n+1)'th set, and the second branch of each of the bends in the last set is connected to one of the plurality of second ports. In addition, the second branches of each of the bends in at least one set lead extend in the first direction, and the second branches of each of the bends in at least one other set, not including the last set, extend in a direction opposite to the first direction.

Preferably, the first and second branches of each waveguide bend meet at an angle substantially equal to 90°, the separate branches of the waveguide junctions are generally collinear to one another, and the common branches of each waveguide junction intersects the two separate branches of that junction generally orthogonally. Also preferably, the second branches of each bend in each set, other than the first set, extend in a direction opposite to the second branches of each bend in the previous set. Each second port may be generally connected to a respective antenna element.

The waveguide network may comprise a plurality of separate pieces including a first piece containing all of the E-plane junctions and E-plane bends and a second piece containing all of the H-plane junctions and H-plane bends, the first and second pieces abutting one another when the waveguide network is assembled.

In another aspect, the present invention provides a waveguide network for connecting a first port to a plurality of second ports, the second ports being oriented in a first direction. The waveguide network comprises at least three successive sets of junctions and bends including a first set connected to the first port, a last set connected to the plurality of second ports and at least another set operatively coupled to a preceding set and a following set. The junctions and bends in each set are one of (i) E-plane junctions and E-plane bends and (ii) H-plane junctions and H-plane bends. Successive sets alternate between a set of E-plane junctions and E-plane bends and a set of H-plane junctions and H-plane bends. Advantageously, the waveguide bends in at least one set extend in the first direction, and the waveguide bends in at least one other set, not including the last set, extend in a direction opposite to the first direction. Preferably, each bend in each set, other than the first set and the last set, leads in a direction opposite to the direction in which the bends in the previous set lead.

The objects and advantages of the present invention will be better understood and more readily apparent with reference to the remainder of the description in conjunction with the accompanying drawings.

BRIEF DESCRIPTION OF THE DRAWINGS

In the drawings which illustrate, by way of example, preferred embodiments of the invention.

DETAILED DESCRIPTION OF THE INVENTION AND PREFERRED EMBODIMENTS

Figure 1:
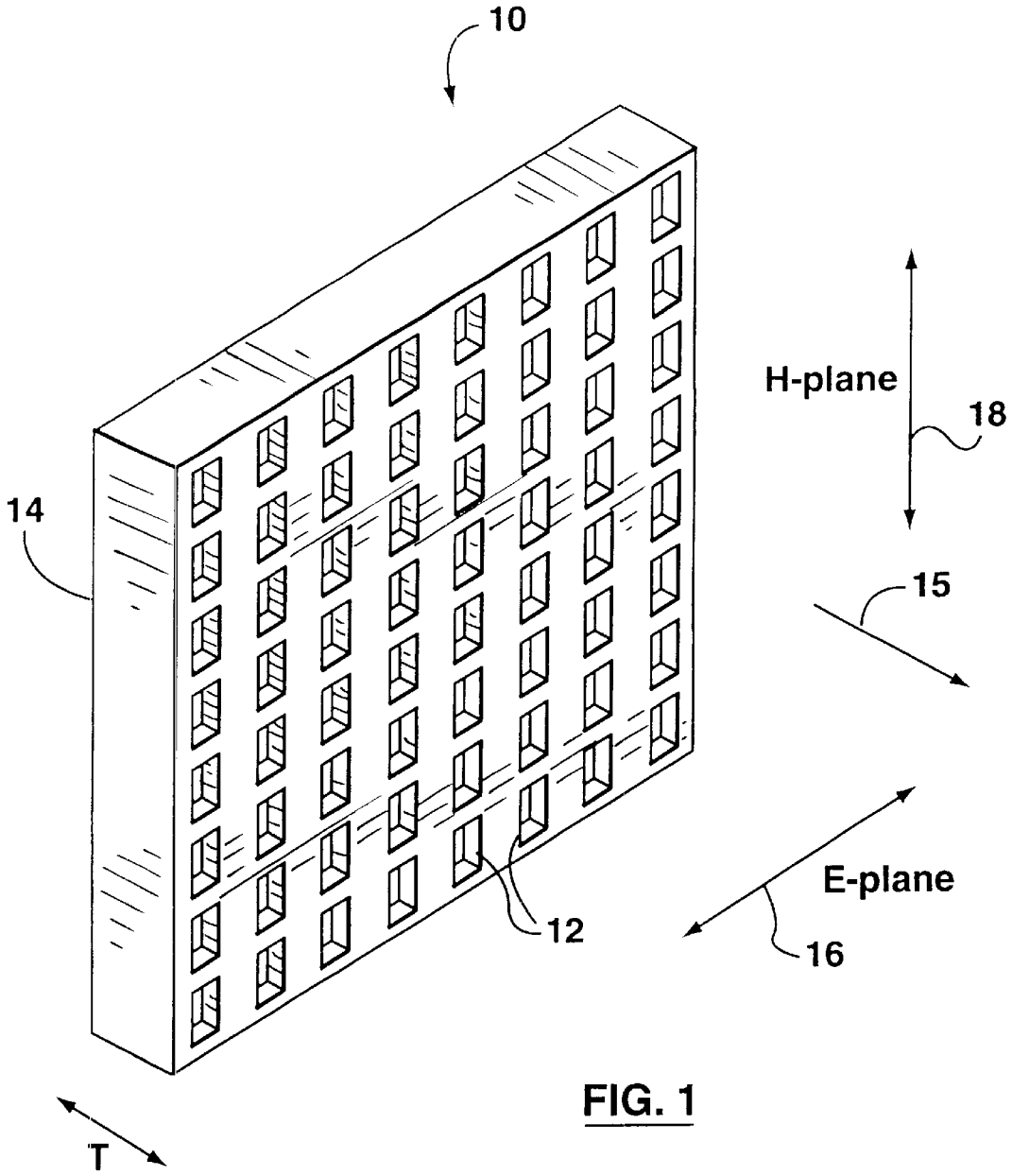
FIG. 1 shows a planar slot array.

FIG. 1 shows a planar slot array 10 having a plurality of slot antenna elements 12. Each of the slots or apertures 12 is connected to (or fed by) a waveguide network (not shown) contained within the housing 14 of the array. As shown in FIG. 1, the housing 14 of the slot array 10 has a profile or thickness T. Note that the slots 12 may have smaller dimensions (i.e. height and width) then the dimensions of the waveguide which is connected to the slots. Alternatively, the slots could simply be the open ends of the waveguide and so may have the same dimensions. While the description which follows relates primarily to a radiating slot array, it will be clear to those skilled in the art that the discussion is equally applicable to a slot array for receiving electromagnetic transmissions. In FIG. 1, arrow 15 indicates a radiating direction of the antenna array 10, but if reversed could equivalently identify the receiving direction of the array. In either case, the slots 12 are oriented in the direction of arrow 15, since the free space radiation, whether it is being radiated or received, is parallel to the direction of arrow 15 relative to the slots. In general, the arrow 15 is parallel to the direction in which the slots 12 are oriented (i.e. the direction in which they face). the arrow 15 represents the direction in which the slots 12 are oriented (i.e. the direction in which they face).

In addition, the slot array can be replaced by an array of different types of antenna elements such as in a microstrip patch array, printed dipole array, linear tapered slot array, and so on. For any array element type, a suitable waveguide to element transition is required, as will be well understood by those skilled in the art.

The polarization of an antenna is the direction of the electric field as radiated (or received) by the antenna. For example, with horizontal polarization the electric field is horizontal and the magnetic field is vertical with respect to a ground surface. If an antenna is linearly polarized, the direction of the electric field does not change. Where the antenna is linearly polarized, the plane parallel to the electric field is generally referred to as the E-plane, and the plane parallel to the magnetic field is referred to as the H-plane. The E-plane and H-plane for a linear horizontal polarized antenna array 10 are indicated by double-headed arrows 16 and 18 respectively in FIG. 1. (As discussed below, this polarization also corresponds to the dominant mode propagation in a rectangular waveguide network.)

Figure 2:
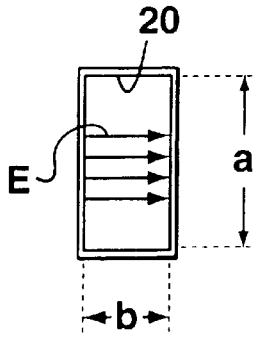
FIG. 2 shows a cross section of a rectangular waveguide.

A waveguide is a well known pipe-like structure with a predetermined rectangular, circular, or other shaped cross-section designed to guide or conduct electromagnetic waves through its interior. The waveguide network of the present invention consists of a waveguide whose cross-section is rectangular-shaped. The cross-section could be only substantially rectangular (for example the corners of the waveguide may be rounded somewhat), but it is preferred that the waveguide cross-section be completely rectangular. FIG. 2 shows a cross section of such a rectangular waveguide of dimension a by b, where $a \gtrsim b$. (Hereinafter a is used to denote the dimension of the rectangular waveguide wall that is normal to the electric field $\bar{E}$ in the waveguide and b is the dimension of the rectangular waveguide wall that is parallel to the electric field $\bar{E}$.) Also, clearly, if a=b, the rectangular waveguide will in fact have a square cross-section.) The inner conducting surfaces 20 of the waveguide are generally metallized, or alternatively the entire waveguide structure can be made of metal.

As is known to those skilled in the art, the propagation mode of an electromagnetic wave travelling within a waveguide describes the electric and magnetic field patterns of that wave. If the electric field is transverse (perpendicular) to the direction of propagation, the wave is in a TE mode; if the magnetic field is transverse to the direction of propagation, the wave is in a TM mode; and if both the electric and magnetic field are transverse to the direction of propagation, the wave is in a TEM mode (note that a wave cannot propagate in the TEM mode in a rectangular waveguide). Furthermore, the number of relative maxima occurring in the field configuration of the waveguide cross section is specified by the subscripts m and n. For example, in a rectangular waveguide, the mode $TE_{mn}$ denotes that the electric field is transverse to the direction of propagation and that the electric field has m relative maxima occurring along the width (b) of the waveguide cross section and n relative maxima along the height (a) of the waveguide cross section. The dominant or fundamental mode is the waveguide mode which has the lowest possible frequency of operation in the waveguide (the critical frequency). The dominant mode propagates through the waveguide in a very low loss manner. In a rectangular waveguide such as in FIG. 2, the dominant mode is the $TE_{10}$ mode with the direction of the electric field $\bar{E}$ (or the electric intensity) being along the shorter dimension, the width b, of the waveguide as shown. For the remainder of this description, it will be generally assumed that a wave is travelling through the waveguide network of the present invention in the dominant $TE_{10}$ mode.

the inter-waveguide wavelength is the distance along a waveguide, at a given frequency and for a given mode, between which similar points of a propagating wave differ in phase by $2\pi$ radians. The normal component of the magnetic field and the tangential component of the electric field are both approximately zero along the inner conducting surfaces 20 of a waveguide. In order for this to occur, there must be transverse propagation constants within the waveguide having wavelengths of at least one-half of the free space wavelength. Therefore, if a is the larger lateral dimension of the rectangular waveguide, the cut-off free space wavelength for the rectangular waveguide is $\lambda<2a$. Generally, the inter-waveguide wavelength $\lambda_g$ is at least slightly greater than the free space wavelength. For example, with $\lambda_0$ denoting the free space wavelength, for the fundamental mode $TE_{10}$ in a rectangular waveguide the inter-waveguide wavelength is $$\lambda_g = \frac{\lambda_0}{\sqrt{1-\left(\frac{\lambda_0}{2a}\right)^2}}$$

In addition to the constraint that $\lambda<2a$, which sets a minimum cut-off frequency for a rectangular waveguide, in some applications it may also be advantageous to have $\lambda>a$ and $\lambda>2b$, as this helps ensure that only the dominant mode and only one orientation of its polarization are freely sustained within the waveguide, avoiding the effective conversion of wave power into higher order transmission modes or polarization states: see generally Tyrell, "Hybrid Circuits for Microwaves", *Proceedings of the I.R.E*, p. 1294 (November 1947). With $a \gtrsim 2$, the operable bandwidth limitations of the dominant mode in a rectangular waveguide are conveniently given by $a<\lambda<2a$. In general, the corresponding lower and upper frequency range limits are proportional to 1/(2a) and 1/a respectively, and therefore the bandwidth is also proportional to 1/a. By scaling the rectangular waveguide dimensions a and b up or down, a waveguide suitable for a desired operable frequency range can be obtained. Thus, for example, with a=420 mil and b=140 mil (where 1 mil= 0.0254 mm), the waveguide would have lower and upper frequency limits of about 14 GHz and 28 GHz respectively.

Figure 3:
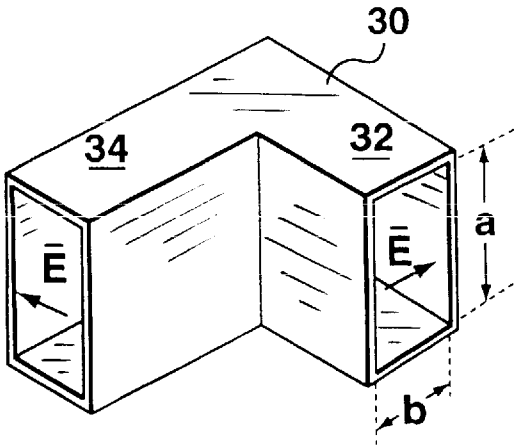
FIG. 3 shows an E-plane bend for a rectangular waveguide.
Figure 4:
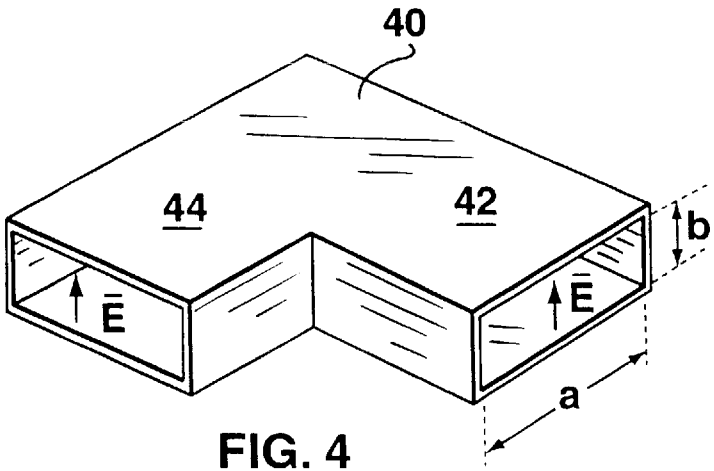
FIG. 4 shows an H-plane bend for a rectangular waveguide.

In order to feed a linear two dimensional array of antenna elements, a waveguide network must include bends and power splitting junctions (or power combining junctions for a receiving antenna). A waveguide bend, also referred to as an elbow, is a section of a waveguide that changes in the longitudinal axis or direction of the waveguide. A waveguide bend has two branches which meet at an angle, preferably 90° Rectangular waveguides commonly include two types of bends. An E-plane bend 30 is shown generally in FIG. 3 and an H-plane bend 40 is shown generally in FIG. 4. In these figures, the dimension a is the dimension of the rectangular waveguide wall that is normal to the electric field $\bar{E}$ in the waveguide and the dimension b is the dimension of the rectangular waveguide wall that is parallel to the electric field $\bar{E}$. For the dominant mode of propagation $TE_{10}$, the E-plane bend 30 provides an effective change in the polarization or the direction of the electric field $\bar{E}$ from a first branch 32 to a second branch 34, as shown in FIG. 3, whereas the electric field is oriented in the same direction in both branches 42 and 44 of the H-plane bend 40, as shown in FIG. 4. The dimensions of a branch input port, e.g. the port of branch 32 or branch 42 may be the same as or may be different than the dimensions of a branch output port, e.g. the port of branch 34 or branch 44.

Figure 5:
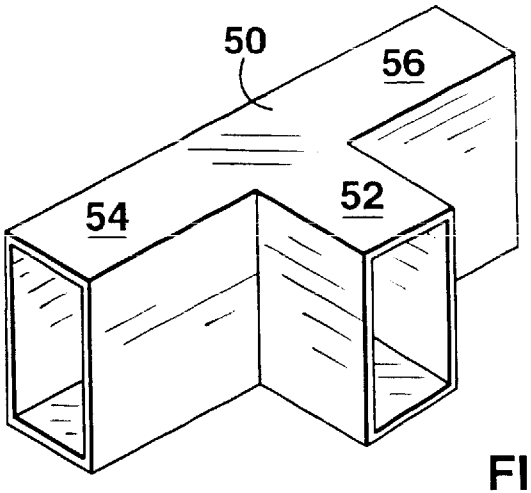
FIG. 5 shows an E-plane junction for a rectangular waveguide.
Figure 6:
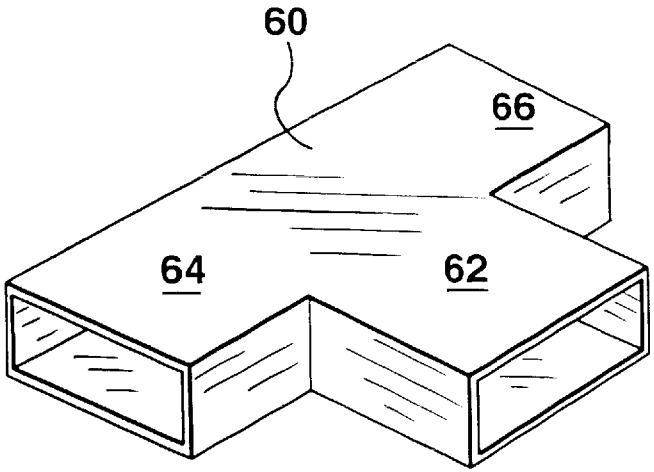
FIG. 6 shows an H-plane junction for a rectangular waveguide.

Similarly, an E-plane power junction 50 and an H-plane power junction 60 are shown in FIGS. 5 and 6 respectively. The junctions are formed from the intersection of a common branch with two separate branches. In the case of a radiating antenna, the junctions serve to divide the propagating wave from the common branch 52 (or 62) into the two separate output branches 54 and 56 (or 64 and 66). (For a receiving antenna, the junction is formed from the intersection of the common branch 52 (or 62) with the two separate input branches 54 and 56 (or 64 and 66) to combine the waves propagating along those input branches within the common branch.) Preferably, the common branch meets the separate branches orthogonally, and the two separate branches are collinear to one another. Because of this preferred geometry, junctions 50 and 60 may also be referred to as "T-junctions" or Tees. A common branch may also form a "Y-junction" (not shown) when it intersects with two separate branches. For a Y-junction, the angle between the common branch and each separate branch is generally greater than 90° and the two separate branches are not collinear. The T-junction geometry is however preferable since it provides a lower waveguide network profile. As discussed in more detail below, for most radiating antennas, the junctions are designed to provide an equal power split between the two separate output branches, however an uneven or non-symmetrical power division may be desirable in some applications.

Figure 7:
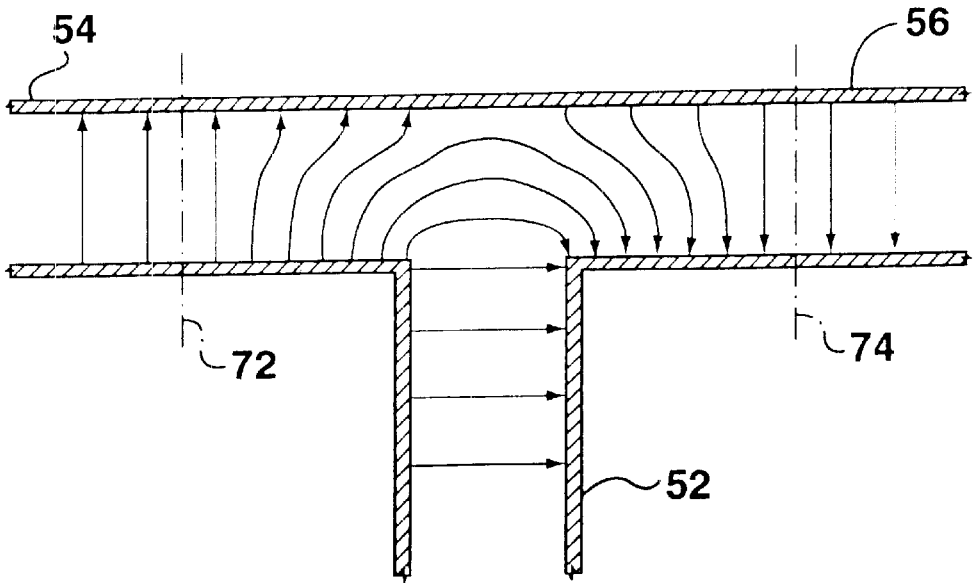
FIG. 7 is a cross-sectional view of the electric field intensity in the E-plane junction of FIG. 5.

FIG. 7 is a cross-sectional view of the E-plane junction of FIG. 5 and shows the (dominant mode) electric field intensity in the three branches 52, 54, and 56. As illustrated, an incident wave in common branch 52 divides into separate output branches 54 and 56 such that the polarizations at equidistant points 72 and 74 (from the center of the junction) along branches 54 and 56 are opposite. Therefore the waves in branches 54 and 56 have opposite polarization or equivalently, when the waves are of equal power, opposite phase.

Where the E-plane junction combines power from (separate input) branches 54 and 56 into branch 52, the waves in branches 54 and 56 will only add if they are of opposite polarization. On the other hand, if the waves propagating in branches 54 and 56 have the same polarization and the same power, they will cancel and branch 52 will receive no power.

Figure 8:
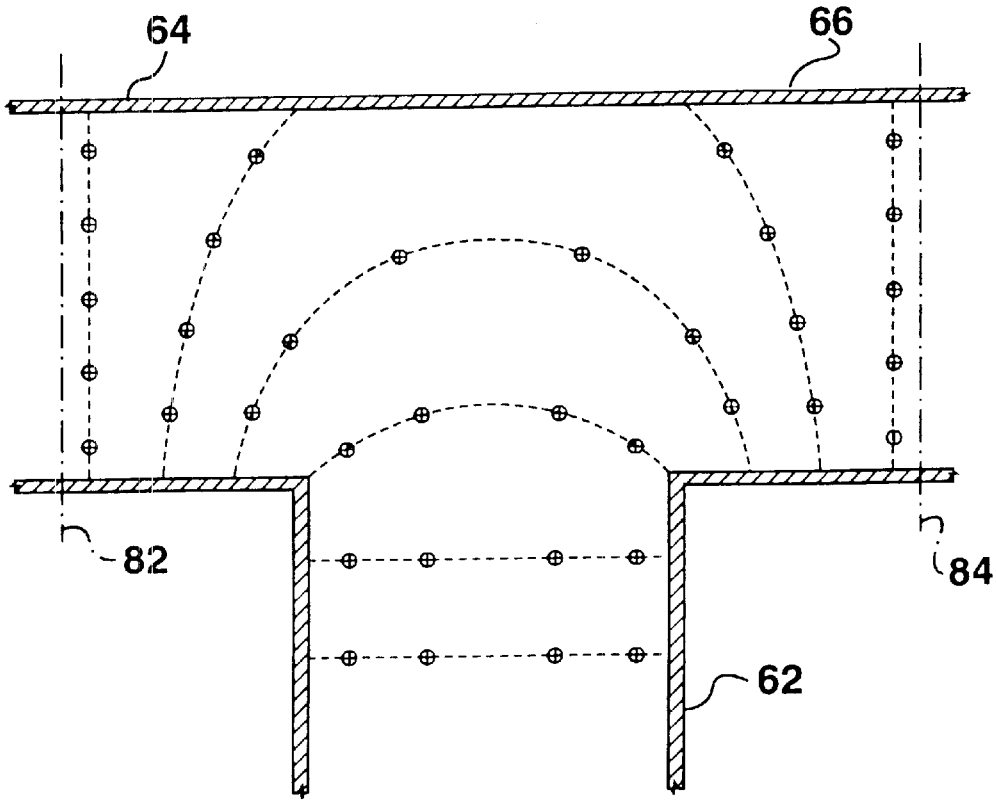
FIG. 8 is a cross-sectional view of the electric field intensity in the H-plane junction of FIG. 6.

Similarly, FIG. 8 is a cross-sectional view of the H-plane junction of FIG. 6 and shows the (dominant mode) electric field intensity in the three branches 62, 64 and 66. The symbol ⊕ denotes that the direction of the electric field is into the page in FIG. 8. Unlike for the E-plane junction, the polarization remains the same for all three branches of the H-plane junction, and so at equisdistant points (from the center of the junction) 82 and 84 along branches 64 and 66 respectively the polarization is the same.

As mentioned, prior art waveguide networks that include these types of waveguide bends and junctions or similar waveguide sections such as multiplexers are generally large and bulky, in particular with respect to the thickness or profile (shown by T in FIG. 1) of such networks.

In accordance with the principles of the present invention, a waveguide network for a two dimensional array of slot antenna elements is provided, the waveguide network having a substantially reduced thickness, without sacrificing the ability to connect the network to a tightly spaced array of antenna elements and without the waveguide network having to consume a greater length or width (i.e. having a larger footprint) than is typically necessary in the prior art.

Figure 9:
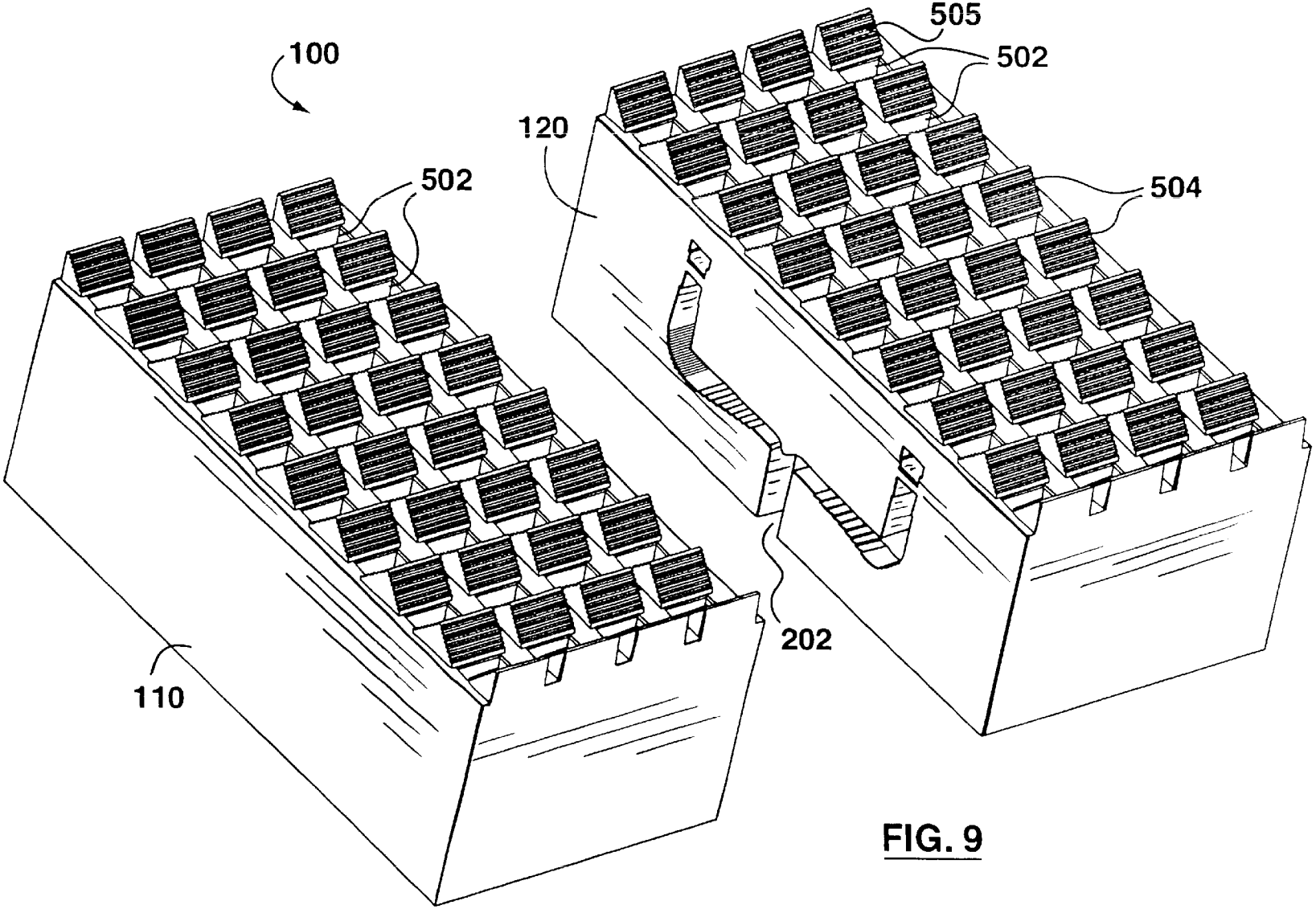
FIG. 9 shows a partially exploded front perspective view of a slot array having a waveguide network according to the present invention.

FIG. 9 shows a partially exploded front perspective view of a radiating slot array 100 having a waveguide network with compactly arranged waveguide bends and junctions in accordance with the present invention. (As indicated above, the present invention is equally applicable to a waveguide network for a receiving slot array. However, for convenience, a radiating slot array is described below with the common branch of a junction being sometimes referred to as an "input branch", and the separate branches of a junction being sometimes referred to as "output branches".) For illustrative purposes, two symmetrical half sections 110 and 120 divided along a median through the array 100 are shown in FIG. 9. The waveguide network begins at an input port 202 at the rear of the array 100 and ends at each of the slot antenna elements 502 in the antenna array (in the illustrated embodiment the array is an eight by eight array of antenna elements). As shown in FIG. 9, the antenna slot elements may be configured as tapered slots by means of fin elements 504 positioned between adjacent slots 502 and half-fin elements 505 (for where there is no adjacent slot). The details of the waveguide network according to a preferred illustrated embodiment of the present invention will now be described in detail with reference to FIGS. 10–22.

With regards to FIGS. 10 to 13, 18, 23 and 24, the double headed arrows 16 and 18 correspond to an orientation of an E-plane and an H-plane respectively.

Figure 10:
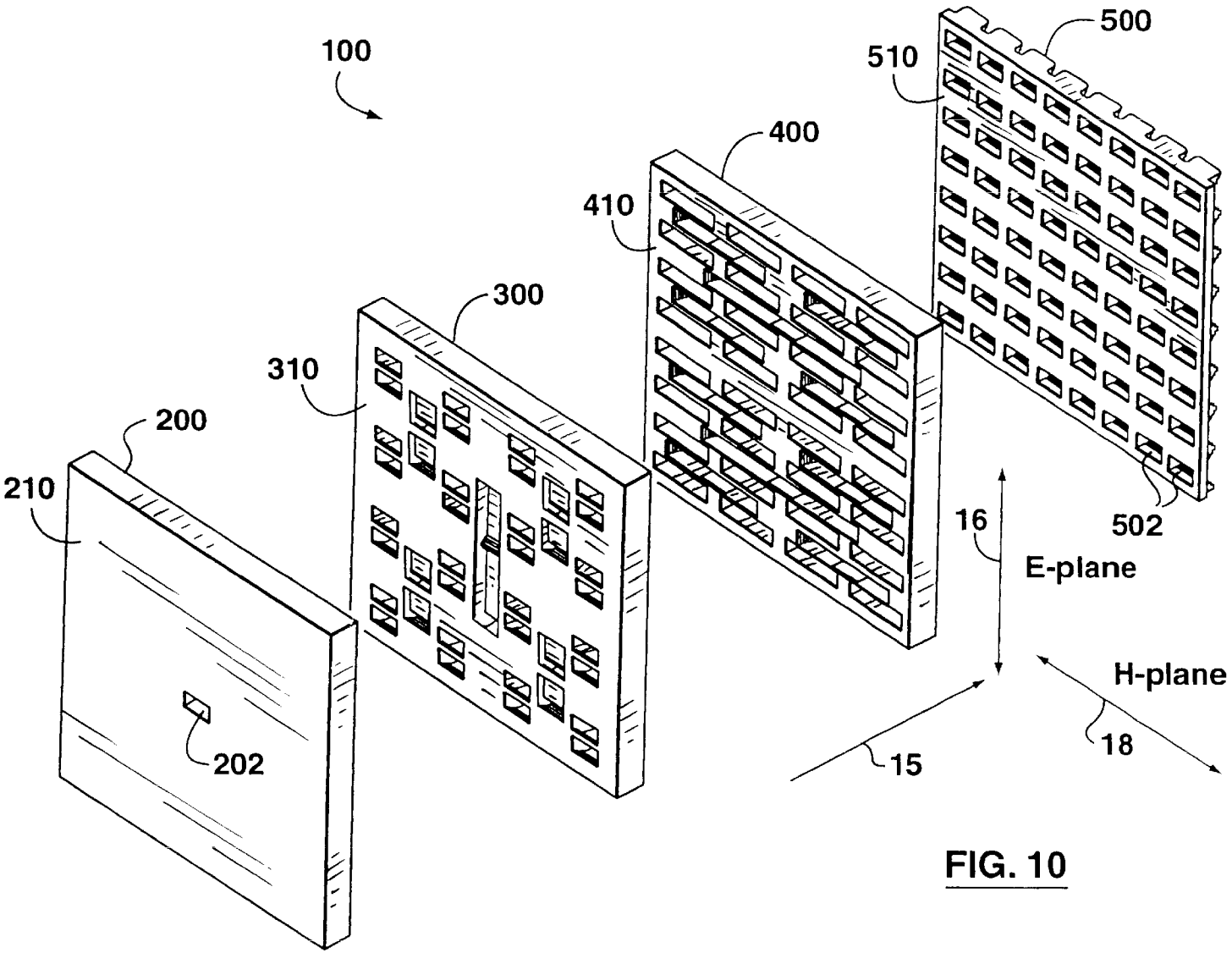
FIG. 10 shows a rear perspective view of the waveguide antenna exploded into four pieces.
Figure 11:
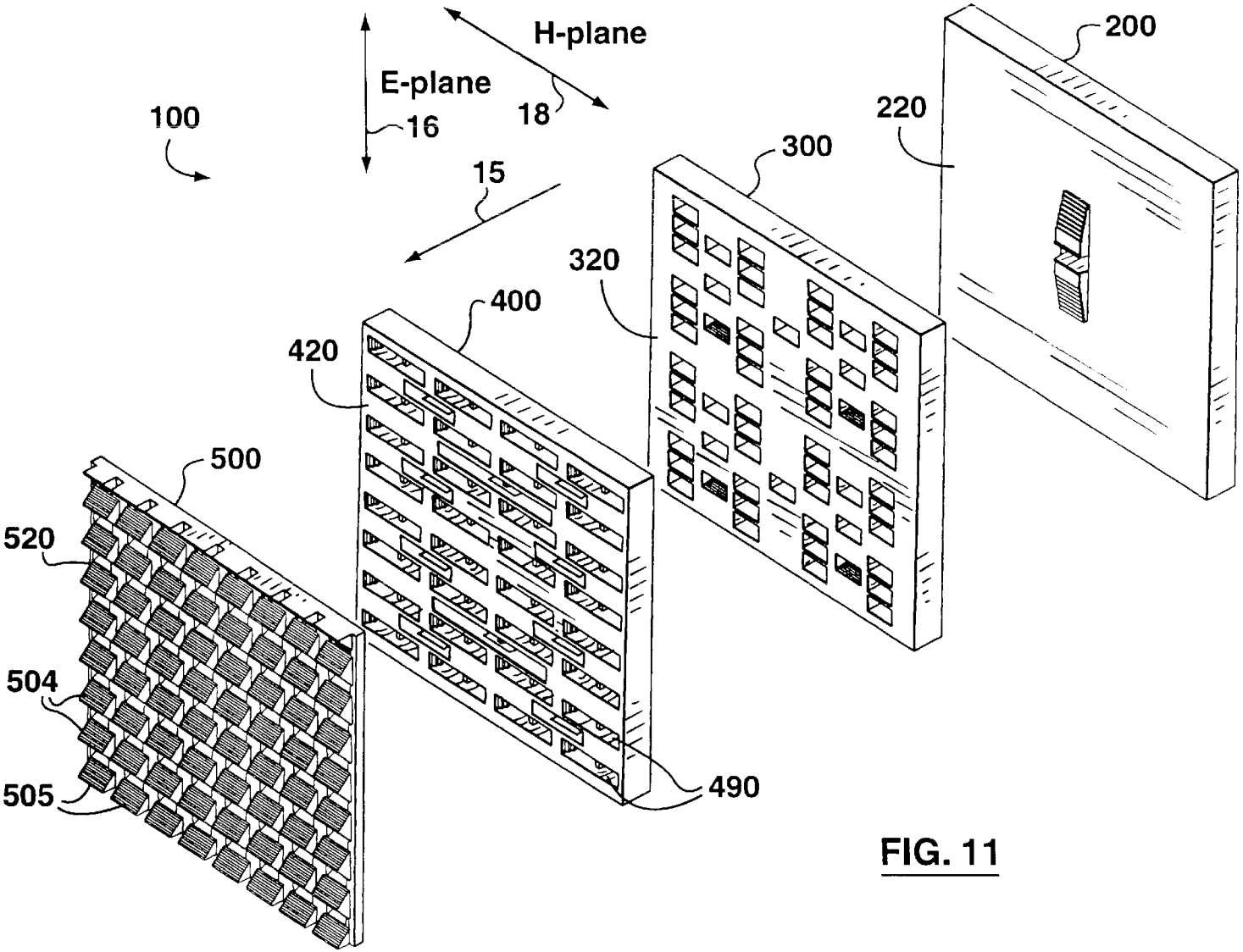
FIG. 11 shows a front perspective view of the waveguide antenna exploded into the same four pieces as in FIG. 10.

FIG. 10 shows a rear perspective view (from the point of view of arrow 15) of the waveguide antenna array 100 exploded into four pieces 200, 300, 400, and 500. Similarly, FIG. 11 shows a front perspective view of the waveguide antenna array 100 exploded into the same four pieces 200, 300, 400, and 500. Conveniently, the pieces 200, 300, 400, and 500 can be "cut" or manufactured separately, for instance using an injection plastic molding technique, plated with copper, and then assembled together to form the complete antenna array 100. This provides a rapid and inexpensive way of manufacturing the array 100. Further simplification can be achieved by combining pieces 200 and 300 together as well as pieces 400 and 500 together to provide a two piece antenna array, which may further reduce manufacturing costs. However, for clarity, the illustrative pieces 200, 300, 400, and 500 are used herein to illustrate the present invention.

The pieces 200, 300, 400, and 500 may be constructed entirely of a conductive material such as aluminum or copper, or alternatively they can have their surfaces metallized (as described above) or the like to provide the necessary conduction properties.

In the illustrated embodiment of FIGS. 10 and 11, the first piece 200 has a surface 210 (FIG. 10) that forms the rear of the waveguide fed antenna array 100 and preferably includes the input port 202 (FIG. 10). The surface 220 (FIG. 11) of piece 200 is shaped to abut against (and assemble together with) the surface 310 (FIG. 10) of piece 300. Similarly, the surface 320 (FIG. 11) of piece 300 and the surface 410 (FIG. 10) of piece 400 are shaped to abut against one another, as are the surface 420 (FIG. 11) of piece 400 and the surface 510 (FIG. 10) of piece 500. As mentioned, the front of the slot array 100 which is formed by the surface 520 (FIG. 11) of piece 500 may have fin-like elements 504 and 505 as shown in FIG. 11 to configure the slots 502 (FIG. 10) as tapers. Generally, any type of antenna element including patch antenna elements, exponentially tapered slot antenna elements, and others could also be used.

In accordance with the present invention, and as will be apparent from the description below, the waveguide network has sections which repeatedly and successively split into two further sections in a beam forming or "binary tree" like manner. In the four piece embodiment illustrated, the waveguide network is principally formed through and within the pieces 300 and 400. In general, however, the waveguide network can be formed within a single piece of material or within more than two pieces. As will be understood by those skilled in the art, the number and general configuration of the pieces affects the manufacturing costs and ease of assembly of the pieces, and so should be chosen accordingly. Perspective views looking toward the surface 310 of piece 300 and looking toward the surface 420 of piece 400 are shown in FIGS. 12 and 13 respectively.

Figure 12:
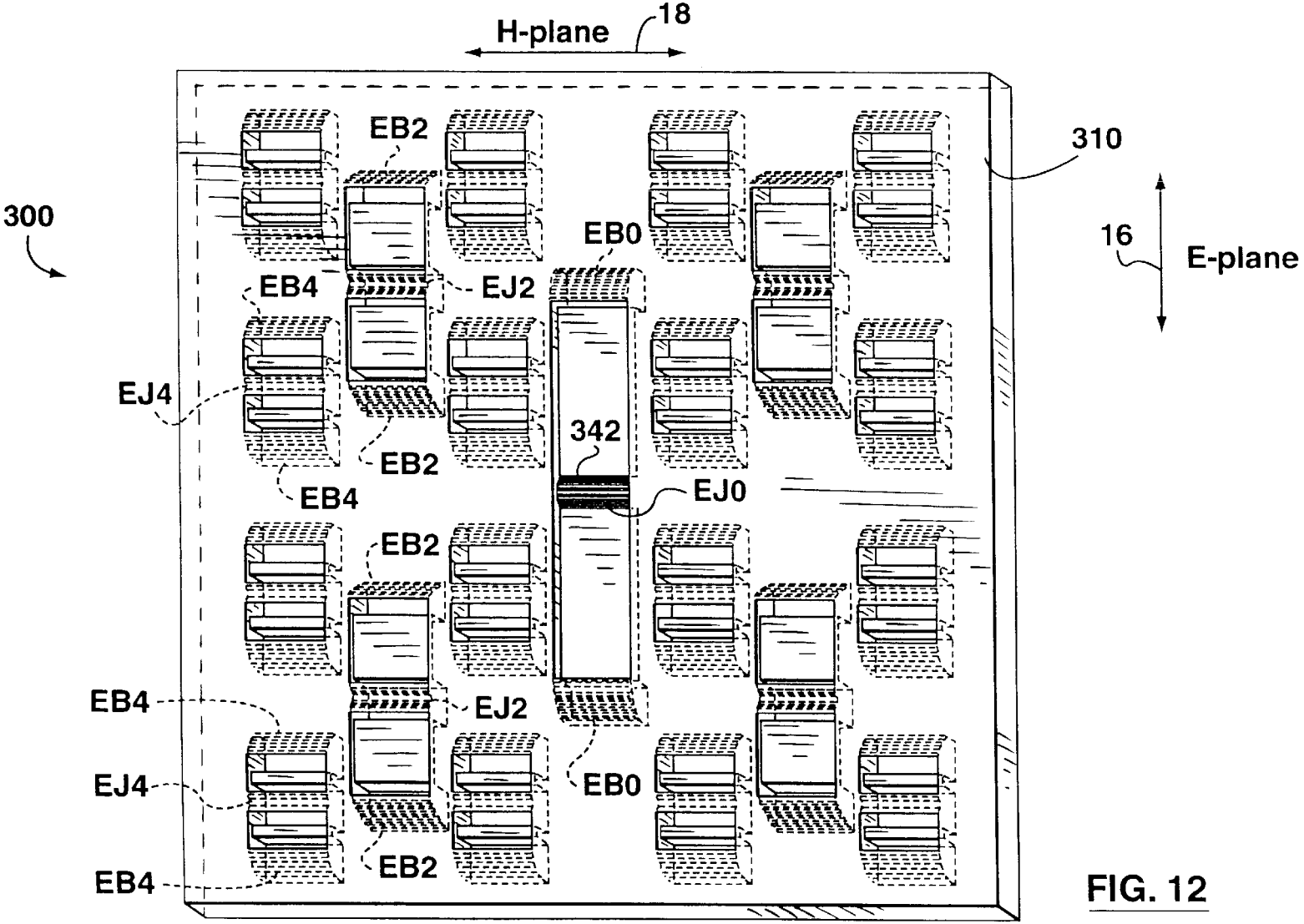
FIG. 12 is a perspective view looking toward a surface of a first piece in FIG. 10.
Figure 13:
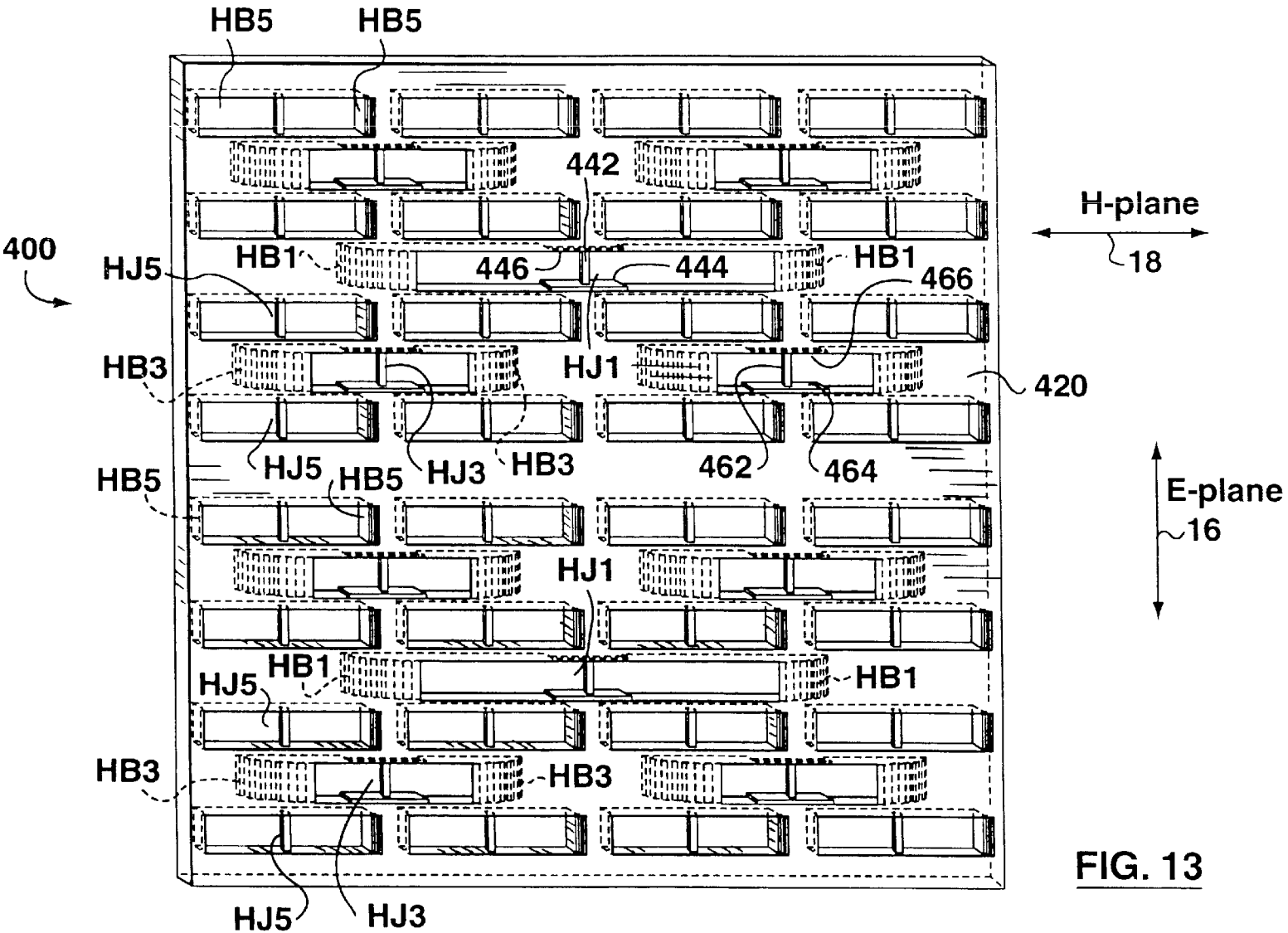
FIG. 13 is a perspective view looking toward a surface of a second piece in FIG. 11.

Referring to FIGS. 10–13, from the input port 202 (FIG. 10), the rectangular waveguide travels through the first piece 200 (FIGS. 10 and 11) and emerges out of the surface 220 (FIG. 11) of the first piece as the input branch to a first E-plane junction EJ0 on surface 210 of piece 300 (FIGS. 10 to 12). The junction EJ0 has a notch 342 (FIG. 12) whose purpose is described further below. The waveguide network then splits into two sections, the output branches of the E-plane junction EJ0 (FIG. 12), that run in opposite E-plane directions (along arrow 16) until each reaches a first branch of an E-plane bend EB0 (FIG. 12) in piece 300. As directed by the second branch of each EB0 bend (FIG. 12), each waveguide sections continues, in a forward or fixed direction (along arrow 15) through the piece 300 and out of the surface 320 (FIG. 11), leading into the input branch of an H-plane junction HJ1 (FIG. 13) at the surface 410 (FIG. 10) of piece 400. The junction HJ1 has a post 442 (FIG. 13) whose purpose is described further below. A similar post 462 is shown in FIG. 13 for another junction. As the waveguide network continues in four different sections, each of the two HJ1 junctions (FIG. 13) have output branches that run in opposite H-plane directions (along arrow 18) until each HJ1 output branch (FIG. 13) reaches a first branch of an H-plane bend HB1 (FIG. 13) in piece 400. Unlike the second branches of the EB0 bends (FIG. 12) in piece 300 which are directed forward toward piece 400 (FIG. 10, 11 and 13), the second branches of the four HB1 bends (FIG. 13) are directed rearward (opposite to the fixed direction of 15) through piece 400, out of the surface 410 (FIG. 10) and back into piece 300 (FIGS. 10 to 12). Each of these four waveguide sections subsequently enters, via surface 320 (FIG. 11), piece 300 and the input branch to one of the four E-plane junctions EJ2 (FIG. 12). The output branches of the E-plane junctions EJ2 (FIG. 12) further divide the waveguide network into eight different sections.

Once again, the separate output branches of each E-plane junctions EJ2 (FIG. 12) run in opposite E-plane directions (along arrow 16) until each reaches a first branch of an E-plane bend EB2 (FIG. 12) in piece 300. At the second branch of each E-plane bend EB2 (FIG. 12), the eight waveguide sections continue in a forward direction (along arrow 15) through the piece 300 and out of the surface 320 (FIG. 11), and each becomes the common input branch to an H-plane junction HJ3 (FIG. 13) at the surface 420 (FIGS. 11 and 13) of piece 400. Each of the eight HJ3 junctions (FIG. 13) has a pair of output branches that run in opposite H-plane directions. These HJ3 output branches (FIG. 13) form sixteen separate waveguide sections each of which leads into a first branch of an H-plane bend HB3 (FIG. 13) in piece 400 (FIGS. 10, 11 and 13). Similar to the HB1 bends (FIG. 13), by way of the second branch of each of the HB3 bends (FIG. 13), the sixteen waveguide sections are directed rearward (opposite to arrow 15) through piece 400 (FIGS. 10, 11 and 13), out of the surface 410 (FIG. 10) and back into piece 300 (FIGS. 10 to 12) where they lead into the common input branch of another set of E-plane junctions EJ4 (FIG. 12). The output branches of each E-plane junctions EJ4 (FIG. 12) (which in total now form thirty-two separate waveguide sections) run in opposite E-plane directions until each reaches the first branch of an E-plane bend EB4 (FIG. 12) in piece 300. The E-plane bends EB4 (FIG. 12) have second branches that all lead in the forward direction of arrow 15, leading the thirty-two waveguide sections back out of surface 320 (FIG. 11) and into piece 400 (FIGS. 10, 11 and 13) where they enter the common input branches of another set of H-plane junctions HJ5 (FIG. 13).

Each of the thirty-two HJ5 junctions (FIG. 15) has a pair of output branches that run in opposite H-plane directions and almost immediately lead into the first branch of a forward turning H-plane bend HB5 (FIG. 13). The waveguide sections consisting of the second branches of the HB5 (FIG. 13) bends provide the sixty-four output ports 490 (FIG. 11) of the waveguide network located on the surface 420 (FIG. 13). These output ports 490 (FIG. 11) correspondingly lead into the antenna slot elements 502 (FIG. 10) in piece 500 (FIGS. 10 and 11). The HJ5 junctions and HB5 bends (FIG. 13) preferably have a different configuration from the other H-plane junctions and bends, as will be described in more detail below.

As illustrated, unlike the rearward turning H-plane bends HB1 and HB3 (FIG. 13), the H-plane bends HB5 (FIG. 13) turn forwardly, in the direction of arrow 15. Alternatively, the second branches of the HB5 bends (FIG. 13) could be directed in the opposite direction. However, the specific orientation of the last set of bends in the waveguide network is generally not significant where the bends are in very close proximity to their corresponding junctions and to the output ports, since the bend orientation in the last set will have little or no effect on the thickness of the waveguide network (as in the case of the HB5 (FIG. 13) bends illustrated).

Although all of the junctions and bends in FIGS. 12 and 13 are not labelled for the sake of clarity, it will be clear that the illustrated eight by eight slot array antenna 100 has the following number of bends and junctions:

| Junction/Bend | Number |
|---|---|
| EJ0 | 1 |
| EB0 | 2 |
| HJ1 | 2 |
| HB1 | 4 |
| EJ2 | 4 |
| EB2 | 8 |
| HJ3 | 8 |
| HB3 | 16 |
| EJ4 | 16 |
| EB4 | 32 |
| HJ5 | 32 |
| HB5 | 64 |

The above can be generalized for an n'th set (or level) of E- or H- plane junctions and bends in the waveguide network where the numeric integer digit, n, indicates the set to which the bend or junction belongs. In this manner, there are $2^n$ EJn or HJn junctions and $2^{n+1}$ EBn or HBn bends in the n'th set of junctions and bends. Furthermore, denoting the total number of sets as N, the last set will correspond to n=N-1 (the first set corresponds to n=0).

In accordance with the present invention, the waveguide network has a back and forth arrangement along the radiating (or the receiving) direction, i.e. arrow 15, that effectively and efficiently compacts the waveguide network, enabling its thickness to be significantly reduced. Consequently, the profile or thickness T of the waveguide antenna array can be made much smaller, without sacrificing any bandwidth of the antenna array nor the ability to closely space the slot antenna elements, and without requiring the antenna array to consume a greater footprint in terms of its width and/or length. For example, an eight by eight slot array fed by a four piece waveguide network according to the present invention and for use in the 38 GHz band may have a thickness of only 825 mil (or about 2.1 cm) including 100 mil fin elements 504 and 505. The footprint of such an antenna array is about 2100 mil by 2100 mil (or about 5.3 cm by 5.3 cm). Furthermore, if a two piece design is used (i.e. with pieces 200 and 300 combined as a first piece and pieces 400 and 500 combined as a second piece), the length of the waveguide network between an EBn bend and an HJn+1 junction and between an HBn bend and an EJn+1 junction can be made even shorter, reducing the thickness of the two piece waveguide network to approximately 570 mil (or about 1.5 cm) at the 38 GHz band.

It will also be clear that the waveguide network according to the invention can have complementary sets of E- and H-plane junctions and bends to those described above. In such a waveguide fed eight by eight antenna array embodiment (not shown), the waveguide network would commence with an H-plane junction (i.e. HJ0) and subsequently two H-plane bends (HB0), followed by two E-plane junctions (EJ1) and subsequently four E-plane bends (EB1), followed by four H-plane junctions (HJ2) and subsequently eight H-plane bends (HB2), followed by eight E-plane junctions (EJ3) and subsequently sixteen E-plane bends (EB3), followed by sixteen H-plane junctions (HJ4) and subsequently thirty-two H-plane bends (HB4), followed by thirty-two E-plane junctions (EJ5) and subsequently sixty-four E-plane bends (EB5). If this complementary embodiment were implemented with four separate pieces similar to the embodiment of FIGS. 10 and 11, the piece having the H-plane junctions and bends would be disposed rearward (from the perspective of arrow 15) to the piece having the E-plane junctions and bends.

Figure 14:
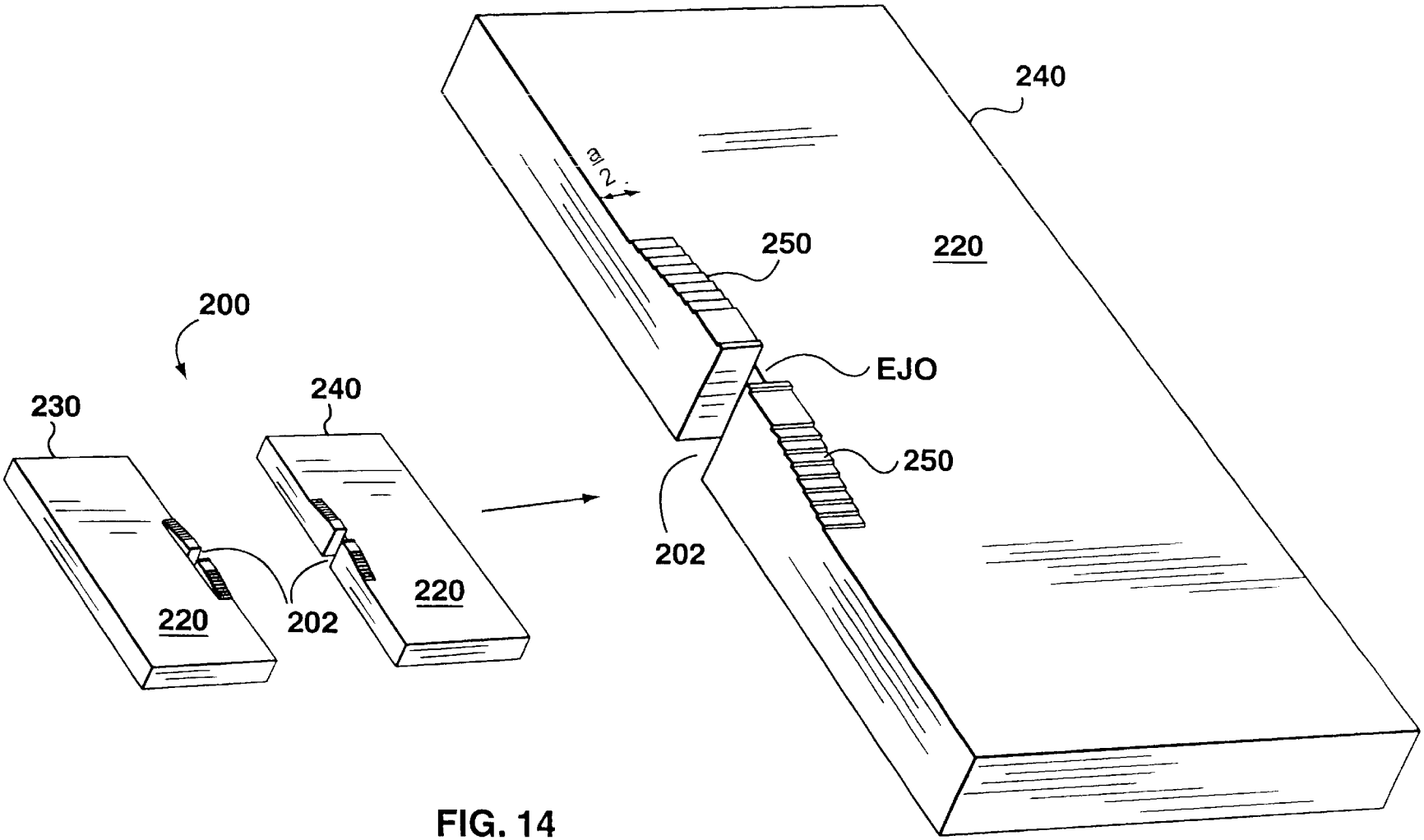
FIG. 14 shows an exploded perspective view of a first piece in FIGS. 10 and 11.

Portions of the pieces 200, 300, 400, and 500 in FIGS 10 and 11 are shown in more detail in FIGS. 14–17 respectively. Throughout the drawings, the E- and H-plane junctions illustrated are merely exemplary and other types of T-junctions can also be used. It should also be noted that the E- and H-plane junctions may have branches with ports of different size or the same size, and that this will generally depend on the specific performance requirements of a given design. FIG. 14 shows an exploded perspective view of the piece 200 in two symmetrical segments 230 and 240, with the segment 240 also shown with greater magnification. The waveguide network commences at input port 202 as a single waveguide section which leads into the input branch for the E-plane junction EJ0. As shown in FIG. 14, the wall of the collinear output branches of junction EJ0 that is provided by the surface 220 of piece 200 includes a stepped or stair case structure 250 along the height a of the waveguide. The stair casing 250 may serve to reduce possible reflection losses at the EJ0 junction. Furthermore, the EJ0 junction can be replaced by a magic-T junction (also known as an E-H-T junction) having both an E-plane input branch and an H-plane input branch, and with the H-plane input branch terminated by a matched load.

It should be noted that, depending on the specific waveguide size, materials, and manufacturing techniques that are used, many modifications similar to the staircasing 250 may be made to the walls of the junctions or bends of the waveguide network to attempt to reduce losses and avoid propagation mode conversions. However, the waveguide network is generally already a low loss line compared to other types of transmission lines, such as a microstrip line or a coplanar waveguide, and so such modifications, while they may improve performance to some extent, are not strictly necessary.

Figure 15:
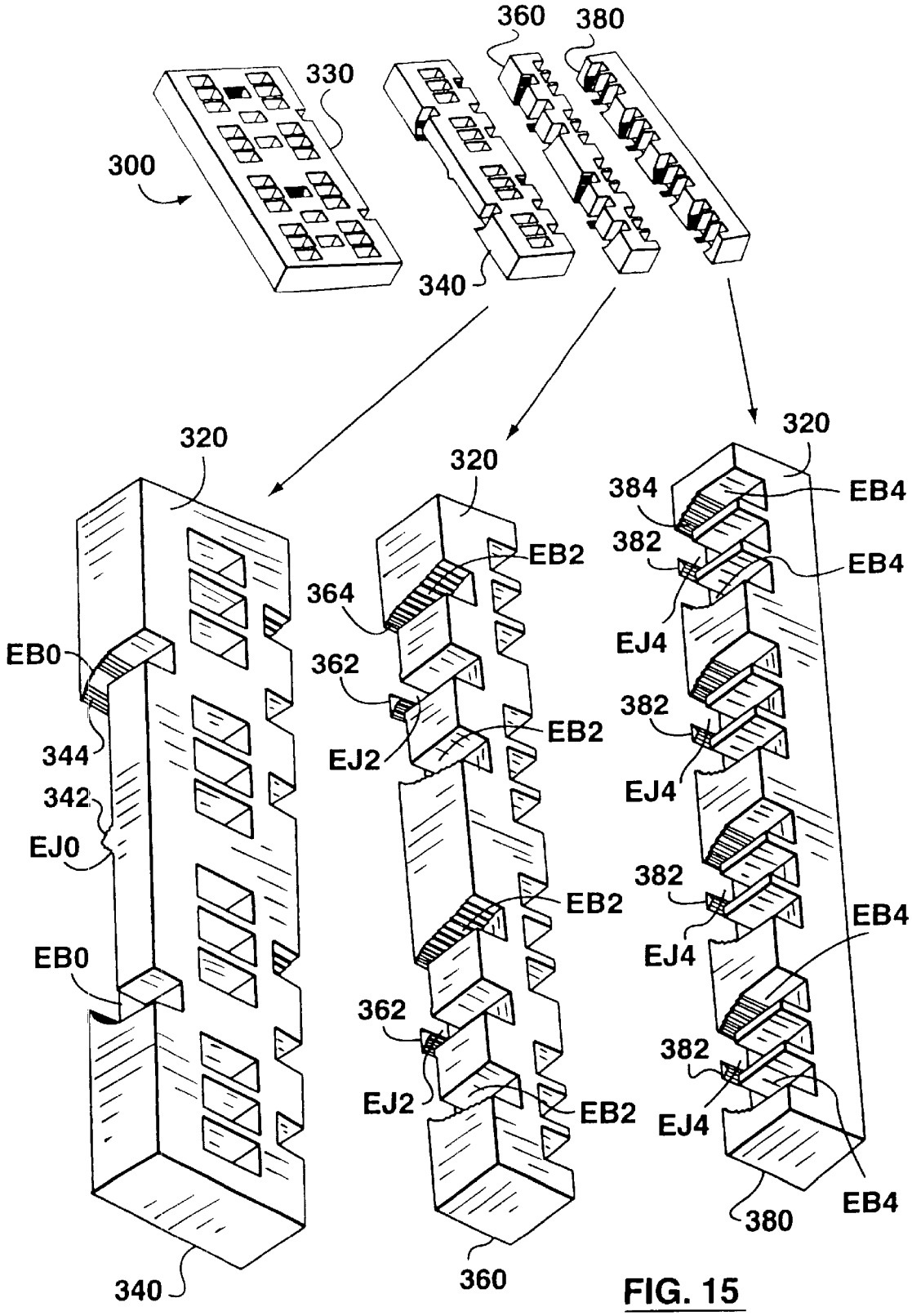
FIG. 15 shows an exploded perspective view of a second piece in FIGS. 10 and 11.

FIG. 15 shows an exploded perspective view of the piece 300 in four segments 330, 340, 360, and 380 viewed from the same surface 320. The segments 340, 360, and 380, which are also shown with greater magnification in FIG. 15, form a symmetrical half of the piece 300 (similar to the segment 330). Segment 340 provides a bisected view of E-plane junction EJ0 and subsequent bends EB0 identified by the numeric label 344. As shown, the EJ0 junction preferably has a notch 342 centered along the wall between the output branches of the junction. The notch 342 is generally V-shaped and extends parallel to the height a of the waveguide wall. The notch 342 may have a stepped or staircase like structure. Again, the notch 342 may help improve the electrical properties of the junction.

It may be noted that, by positioning the notch away from the center of the width b of the waveguide (not shown), an E-plane junction with unequal power splitting is obtained. This may be beneficial, for instance, when a shaped distribution across the array elements is used to reduce sidelobes in the radiation pattern of a transmitting antenna array. Low sidelobes help ensure that different sets of communicating antenna arrays do not interfere with one another, and sidelobes levels are often governed by a communication protocol, such as the United States Federal Communications Commission (FCC) category "A" specifications (see for example FCC 96-80, Notice of Proposed Rule Making, and FCC 97-1, Report and Order.) Non-symmetrical E-plane power dividers are discussed in Arndt et al, "Optimized E-Plane T-junction Series Power Dividers", IEEE *Transactions on Microwave Theory and Techniques*, Vol. MTT-35, No. 11, p. 1052 (November 1987). However, all of the E-plane junctions in the illustrated embodiment are shown as equal power splitting junctions with a notch centered between the output branches of the junction.

The bends EB0, and in general the other bends in the waveguide network, also preferably turn more gradually than the sharp bend illustrated in FIG. 3. This additionally may help to minimize transmission losses, by reducing reflections and avoiding possible propagation mode conversions.

Segment 360 shows a bisected view of two E-plane junctions EJ2 with subsequent bends EB2, whereas segment 380 shows a bisected view of four E-plane junctions EJ4 with subsequent bends EB4. The junctions EJ2 have notches 362 and the junctions EJ4 have notches 382 similar to the notch 342 in junction EJ0. Also, the bends EB2 and EB4 may have staircased turns 364 and 384 respectively, similar to the turn 344 for the bend EB0. The bends EB2 are more closely spaced to the junctions EJ2 than the bends EB0 are to the junction EJ0, and likewise the bends EB4 are more closely spaced to the junctions EJ4 than the bends EB2 are to the junctions EJ2. This allows the waveguide network to connect to a tightly spaced antenna array.

Figure 16:
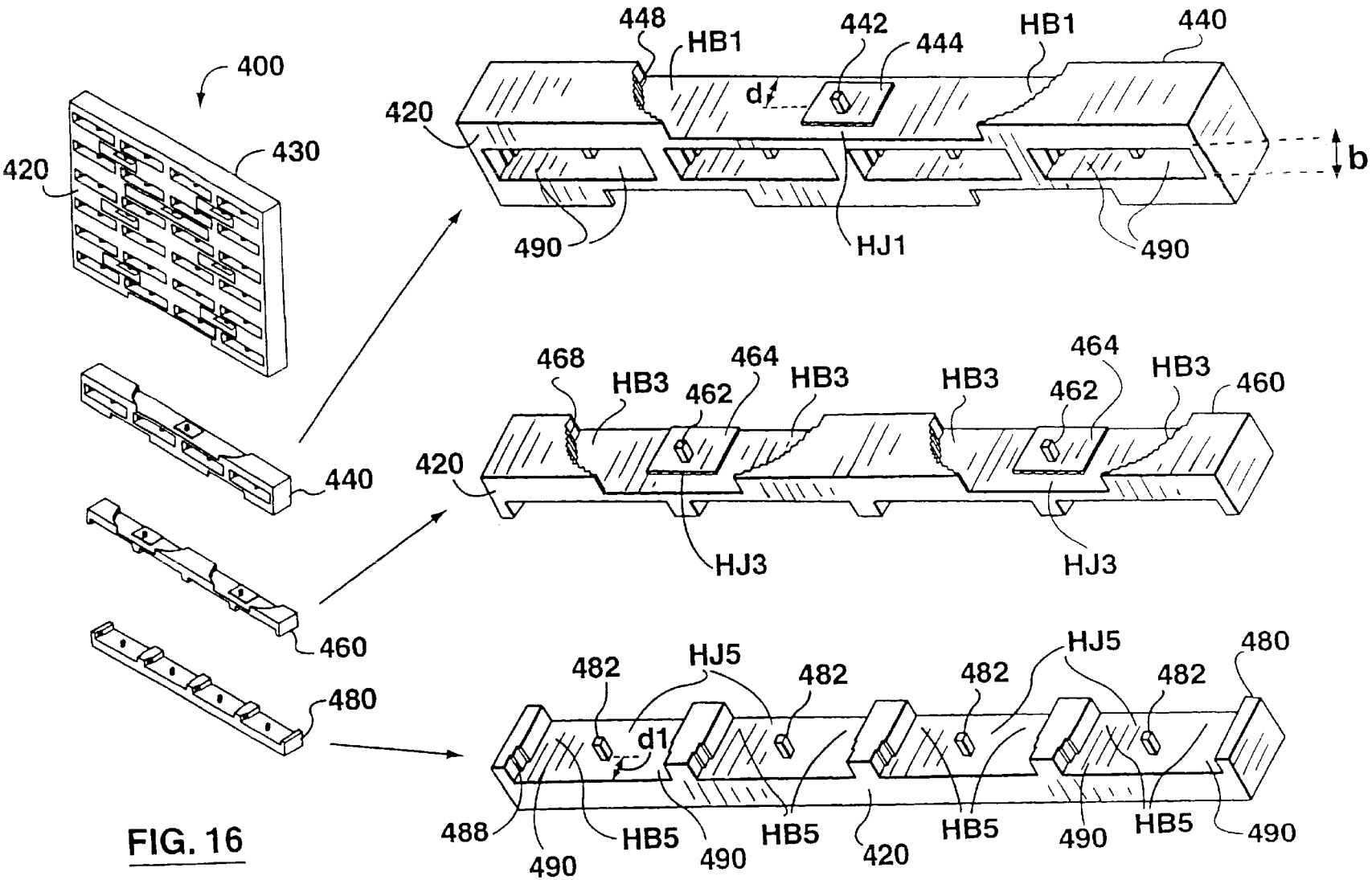
FIG. 16 shows an exploded perspective view of a third piece in FIGS. 10 and 11.

FIG. 16 shows an exploded perspective view of the piece 400 in four segments 430, 440, 460, and 480 as viewed from surface 420. The segments 440, 460, and 480, which are also shown with greater magnification in FIG. 16, together form a quarter segment of the piece 400. Segment 440 provides a bisected view of H-plane junction HJ1 and subsequent bends HB1. As shown, the junction HJ1 preferably has a post 442 located at about the center of the junction and extending parallel to the width b of the waveguide. Although a rectangular post is shown in FIG. 16, other shapes, such as cylindrical, may also be used. The post acts as a shunt susceptance and thereby improves the impedance matching of the junction branches as well as compensates for the junction discontinuity. As indicated in Horokawa et al., "An Analysis of a Waveguide T Junction with an Inductive Post", IEEE *Transactions on Microwave Theory and Techniques*, Vol. 39, No. 3 (March 1991), the "offset" distance of the post from the waveguide wall, denoted by d, should preferably be about ¼ of the inter-waveguide wavelength, while the size of the post is generally independent of frequency and is best determined by way of computer simulation. The impedance match can be improved further by means of a bottom patch 444 and a top patch 446 (see FIG. 13) which protrude slightly from the waveguide walls that are parallel to the H-plane in the H-plane junction HJ1. The post 442 is positioned between the patches 444 and 446, as shown.

Segment 440 also includes the bends HB1 which again turn more gradually than the sharp bend illustrated in FIG. 4 and which may have a stepped structure along the waveguide wall as shown at 448. Segment 440 additionally show eight of the output ports 490 of the waveguide network.

Referring still to FIG. 16, segment 460 shows a bisected view of two H-plane junctions HJ3 with subsequent bends HB3. The junctions HJ3 have a post 462, lower patch 464 and upper patch 466 (see FIG. 13) similar to the junctions HJ1. The bends HB3 are also shown with a staircased wall 468 along their turns. Segment 480 shows a bisected view of four H-plane junctions HJ5 with subsequent bends HB5. The junctions HJ5 also have a post 482 offset by a distance d1 from a waveguide wall (located on piece 500 and shown at 532 in FIG. 17). The output branches of the junctions HJ5 almost immediately enter the H-plane waveguide bends HB5 which may have a lesser amount of staircased wall 488 along the turn of each bend. Each bend HB5 leads into an output port 490 of the waveguide network. Similar to the E-plane junctions, the bends HB3 are more closely spaced to the junctions HJ3 than the bends HB1 are to the junctions HJ1, and likewise the bends HB5 are more closely spaced to the junctions HJ5 than the bends HB3 are to the junctions HJ3. Again, this allows the waveguide network to have a smaller footprint (width and length) and to connect to a tightly spaced array of antenna elements.

As indicated, other types of E- and H-plane junctions can be used, and, as discussed above, some of the H-plant junctions, for instance, can be designed with unequal power splitting to provide a weighted array designed to achieve particular sidelobe levels.

Figure 17:
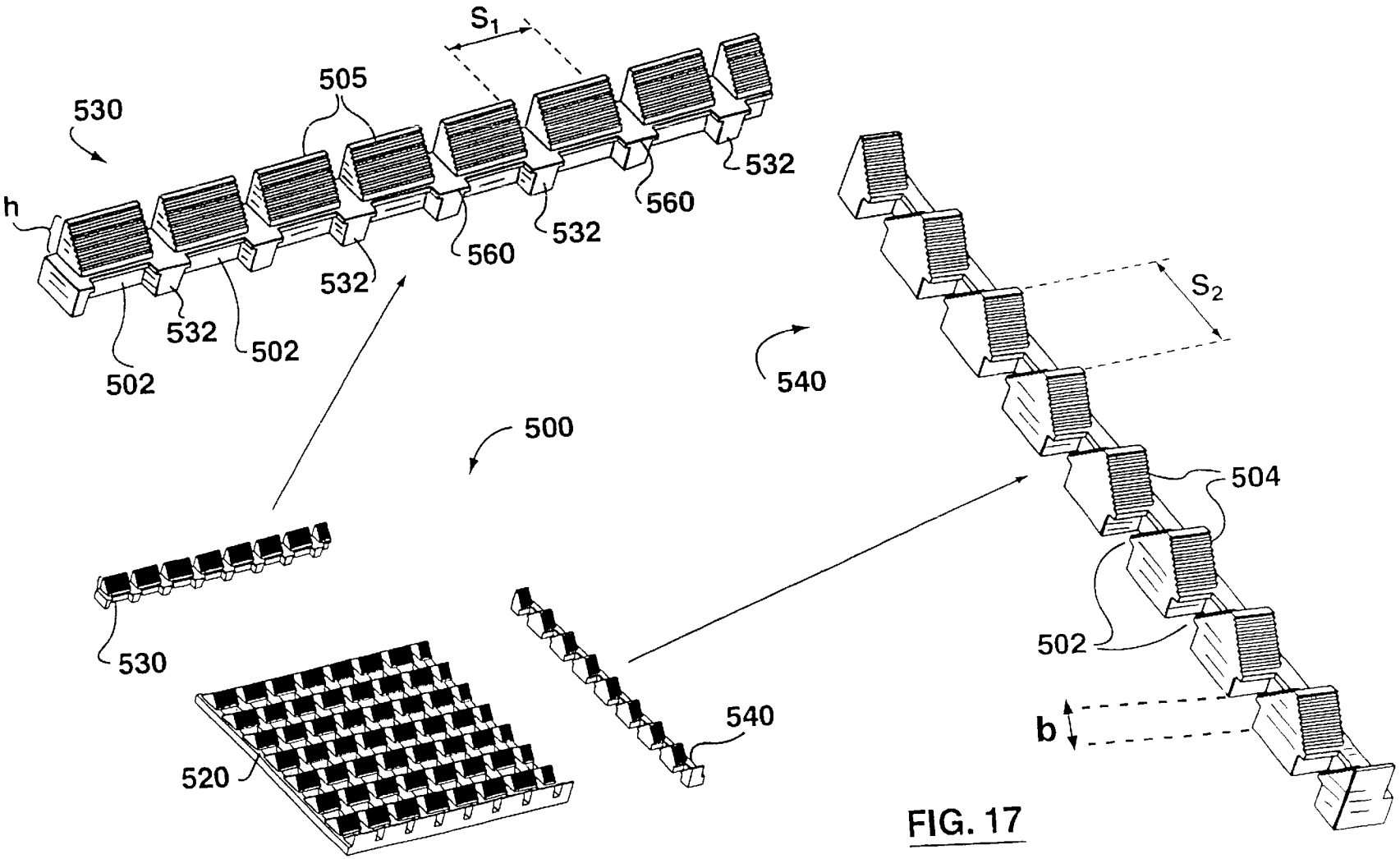
FIG. 17 shows an exploded perspective view of a fourth piece in FIGS. 10 and 11.

FIG. 17 shows a perspective view of the piece 500 with two segments 530 and 540 exploded therefrom. The segments 530 and 540 are generally from the perimeter of piece 500 and are also shown magnified in FIG. 17. The segment 530 shows a bisected H-plane sub-array of slot antenna elements 502, while the segment 540 shows a bisected E-plane sub-array of slot antenna elements 502. As shown, the slot elements 502 may have a surrounding wall 560 on the surface 520 of the piece 500 which narrows the dimensions of the slot antenna elements 502 in comparison to the dimensions of the waveguide (which is of height a and width b). Alternatively, the antenna elements could simply be an open-ended waveguide (i.e. with no narrowing of the waveguide dimensions), patch antenna elements, printed dipole elements, and so on. However, the antenna elements that are shown (comprising the slots 502 and fins 504 and 505) provide certain advantages. First, this combination exhibits narrow E- and H-plane radiation patterns compared with patch, dipole, and open-ended waveguide antenna elements. Second, the transition or match between the waveguide and the elements is both very simple and efficient. Third, the elements are more inexpensive than printed antenna elements once injection molds have been constructed.

The spacing of antenna elements 502 is given by $s_1$ in the H-plane sub-arrays and $s_2$ in the E-plane sub-arrays. As mentioned, the present invention allows the parameters $s_1$ and $s_2$ to be kept small so that the array is tightly spaced, while still reducing the profile or thickness T of the antenna array. Generally, the present invention can provide tight spacing comparable to other waveguide feed structures which have a much larger profile. In general, however, the antenna element spacing will depend to some extent on the type of antenna element used with the array. Also, as indicated above, the inter-slot wall portions 532 (shown most clearly on segment 530) are spaced apart from the posts 482 by the distance $d_1$, when the antenna array 100 is assembled.

In the illustrated embodiment, the slot antenna elements 502 are converted into tapered slots by means of fin elements 504 and 505. The half-fin elements 505 are shown on segment 530, and the full fin elements 504 are shown on segment 540. The fin elements 504 and 505, are all of height h above the surface 520 of the piece 500 and serve to configure the slot antenna elements 502 as tapered slot antenna elements. As shown, the slots taper in the E-plane from their maximum width at their aperture (at the height h above the surface 520) to their minimum width at the surface 520). The height h of the fin elements 504 and 505, which in effect is also the length of the tapered slot antenna elements, can be made relatively long, for example 300 mils. By increasing the height h (e.g. $h \geq \lambda_0$) of the fin elements 504 and 505, the gain, directionality, and bandwidth of the antenna elements improves, at the expense of a larger profile. In the alternative, the fins 504 and 505 may mainly be used to improve the impedance matching between elements, and in such a case the height h need only be about 100 mils.

To reiterate, although tapered slot antenna elements are illustrated, the waveguide network of the present invention can be used to feed an array of any type of antenna elements, including plain slot antennas (with no fins or taper), open-ended waveguides, patch antennas (whether circular or rectangular), and dipole antennas. The specific type of antenna element chosen will vary depending on the requirements and specifications of particular applications.

Figure 18:
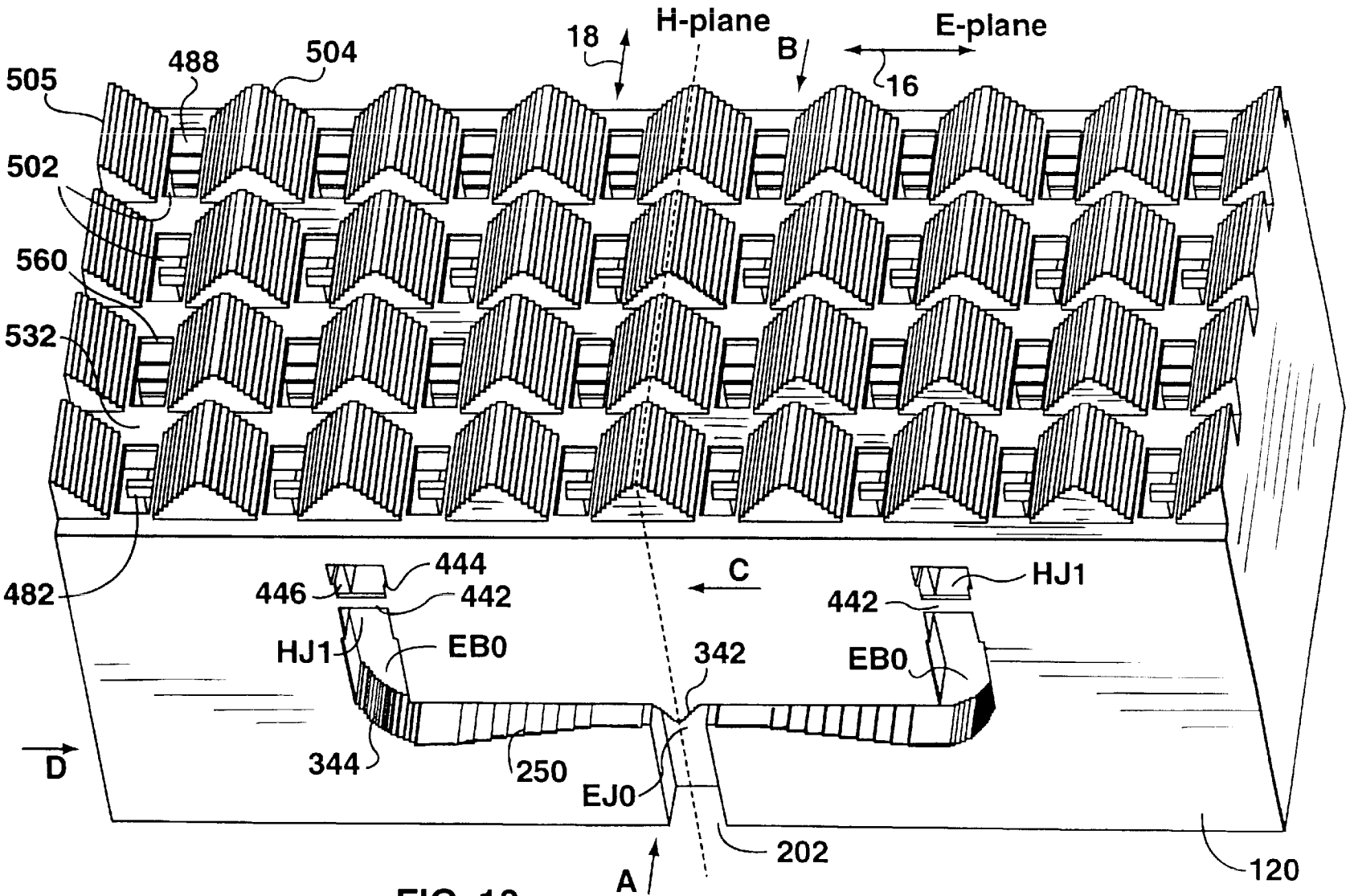
FIG. 18 shows a symmetrical half section of FIG. 9 in closer detail.
Figure 19:
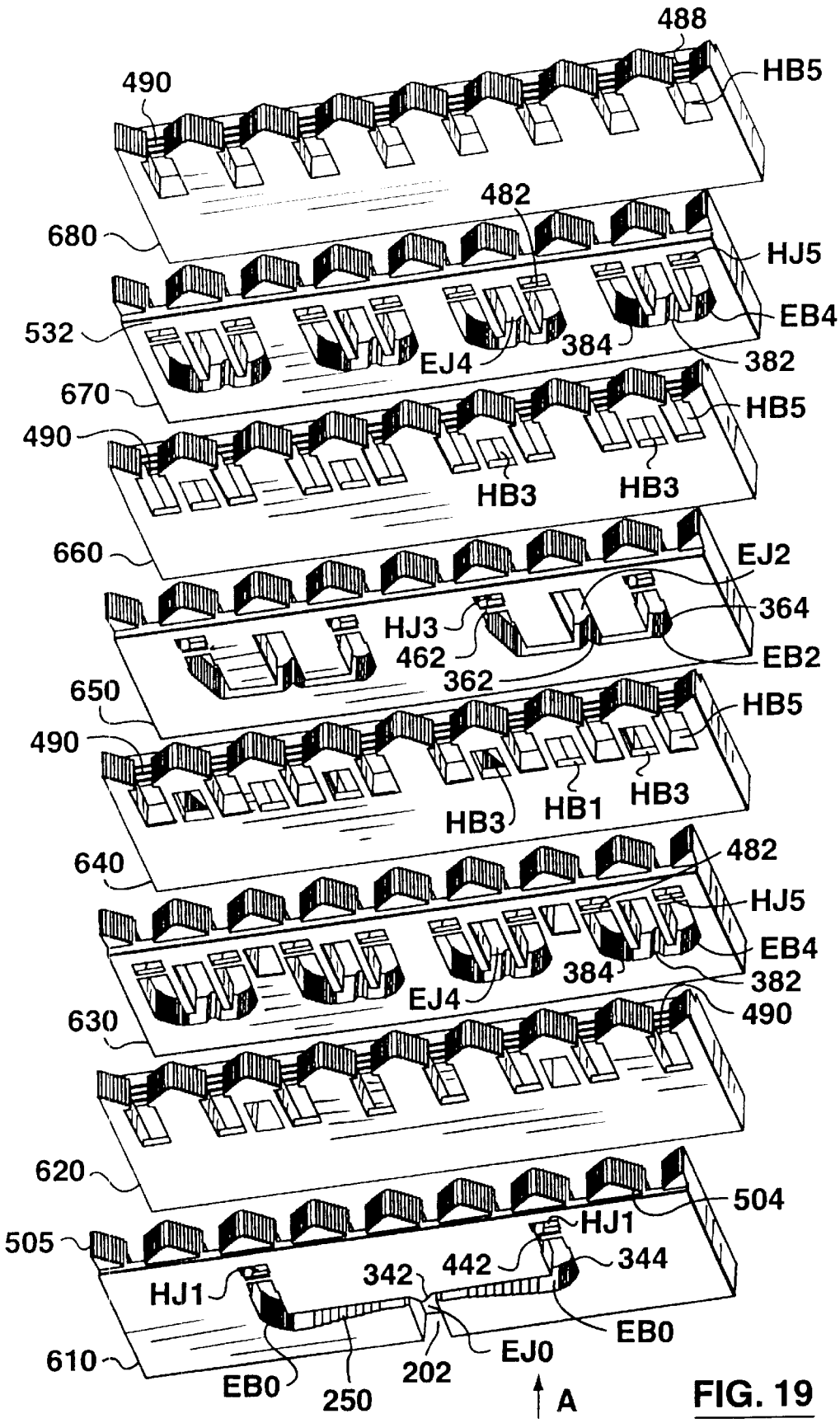
FIGS. 19 and 20 show complementary perspective views of the section of FIG. 18 exploded into eight further sub-sections along the H-plane.
Figure 20:
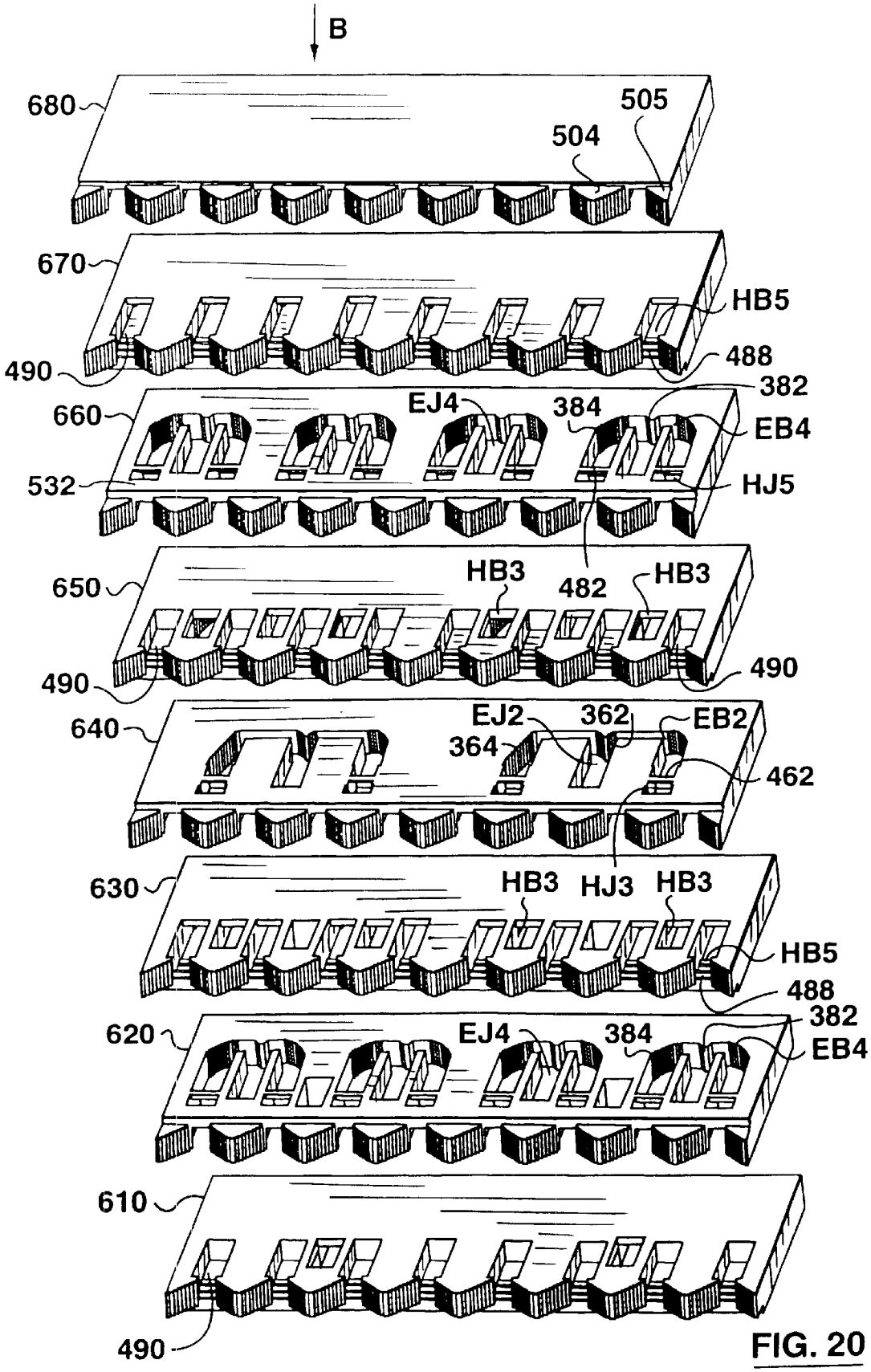
Figure 21:
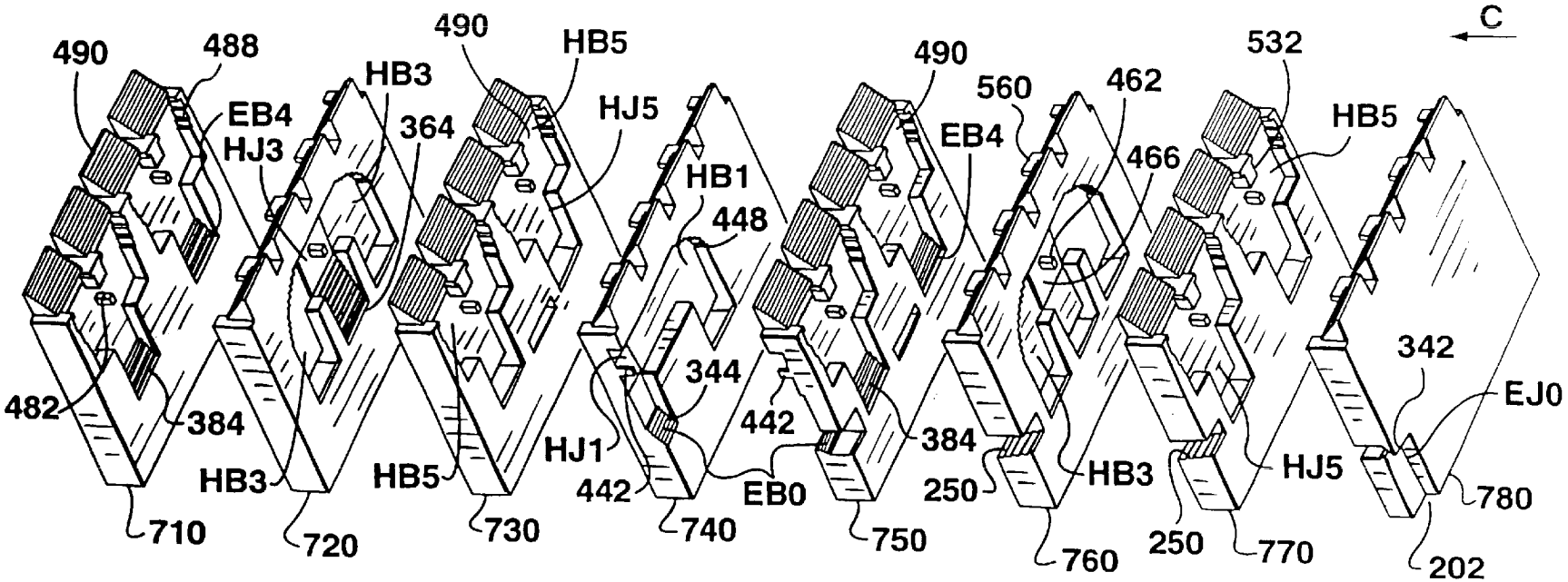
FIGS. 21 and 22 show complementary perspective views of a symmetrical half of the section of FIG. 18 further exploded into eight sub-sections along the E-plane.
Figure 22:
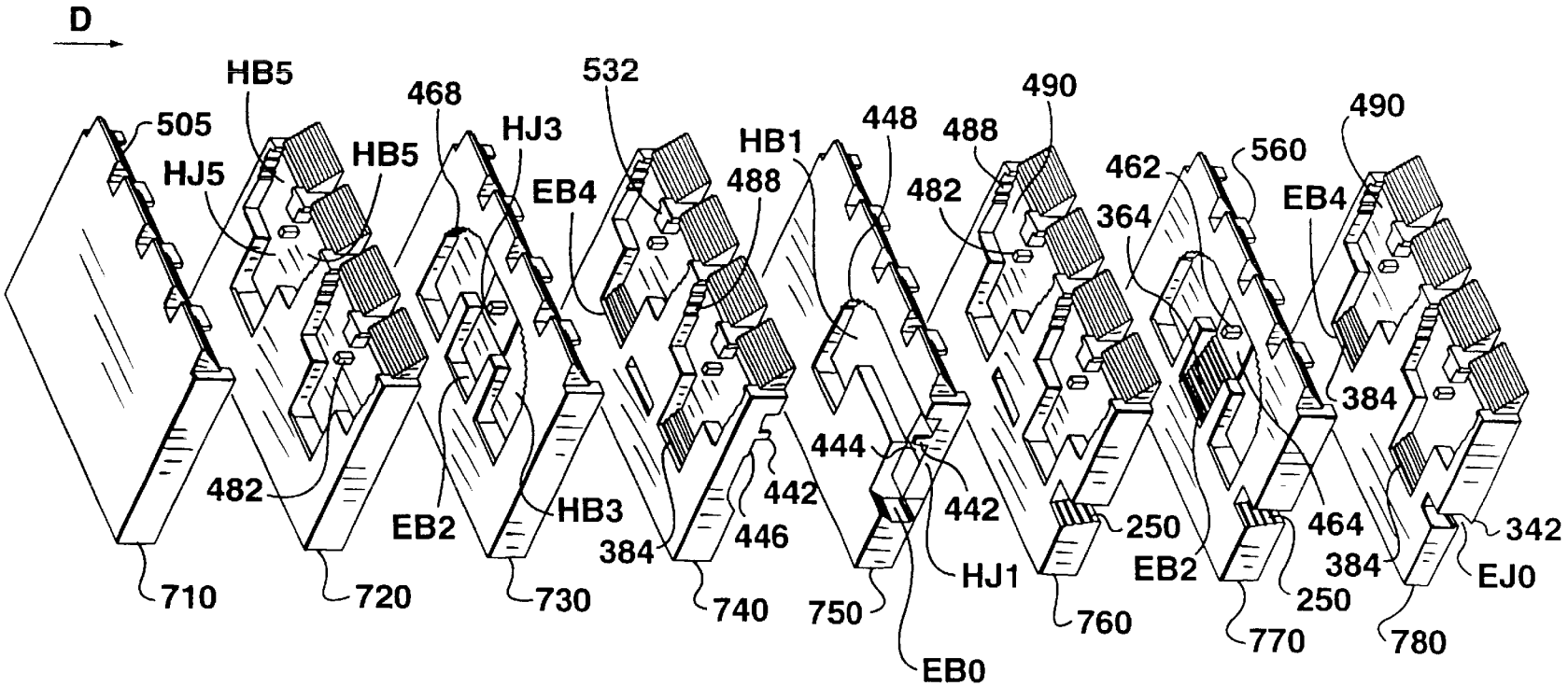

FIGS. 18–22 are provided for further clarity and additional views of the above described illustrated embodiment. FIG. 18 shows the symmetrical half section 120 of FIG. 9 in closer detail. (Note that both FIGS. 9 and 18 show portions of the assembled antenna, e.g. after the four pieces 200, 300, 400, and 500 (FIGS. 10 and 11) have been assembled together.) FIGS. 19 and 20 show complementary perspective views of the sections 120 exploded into eight further subsections 610, 620, 630, 640, 650, 660, 670, and 680 as generally viewed from a perspective in the direction of arrow A and in the direction of arrow B respectively. Similarly, FIGS. 21 and 22 show complementary perspective views of a symmetrical half of the section 120 further exploded into eight sub-sections 710, 720, 730, 740, 750, 760, 770, and 780 as generally viewed from a perspective in the direction of arrow C and in the direction of arrow D respectively. Once again, in FIGS. 19–22, only selective reference numbering is made for increased clarity and readability. Because FIGS. 19–22 simply show additional views of the waveguide network, for the sake of brevity, these figures are not described further herein.

From the above description, it will be clear that the waveguide network of the present invention has junctions and bends which can be grouped into different sets. For example, in the above illustrated embodiment, an initial set 0 has the junction EJ0 (FIGS. 18, 19, 21 and 22) and the two bends EB0 (FIGS. 18, 19, 21 and 22), a subsequent set 1 consists of the two junctions HJ1 (FIGS. 18, 19, 21 and 22) and the four bends HB1 (FIGS. 19, 21 and 22), the next set 2 has four EJ2 junctions (FIGS. 19 and 20) and eight EB2 bends (FIGS. 20 and 22), the next set 3 has eight HJ3 junctions (FIGS. 19, 21 and 22) and sixteen HB3 bends (FIGS. 19 to 22), the subsequent set 4 consists of sixteen EJ4 junctions and thirty-two EB4 bends, and the last set 5 has thirty-two HJ5 junctions (FIGS. 19 to 22) and sixty-four HB5 bends (FIGS. 19 to 22). In each set, the branches of a junction in that particular set each connect to a first branch of a bend in that set.

In the initial set 0, the input port 202 connects to the common branch of the EJ0 junction (FIGS. 18, 19, 21 and 22) (or alternatively an HJ0 junction). In each set except the last, the second branch of each bend in that set subsequentially connects to the common branch of a junction in the next set. In the last set, for example set 5 in the illustrated embodiment described above, the second branches of the bends connect to the output ports 490 (FIGS. 19 to 22). The output ports 490 (FIGS. 19 to 22) of the waveguide network are oriented in the direction in which the array radiates, i.e. in the radiating direction denoted by arrow 15. (Note that for a receiving antenna, the output ports 490 (FIGS. 19 to 22) of the waveguide network are oriented opposite to the direction in which the antenna receives radiation.) Although in the four piece embodiment illustrated and discussed above, the common branch of the junction in the initial set (EJ0 (FIGS. 18, 19, 21 and 22)) and the output ports 490 (FIGS. 19 to 22) are oriented in opposite direction, it is also possible for the common branch of the junction in the initial set (EJ0 (FIGS. 18, 19, 21 and 22)) and the output ports 490 (FIGS. 19 to 22) to be oriented in the same direction. For instance, the HB5 bends (FIGS. 19 to 22) in the above described embodiment could be oriented in the opposite direction to that shown in FIGS. 10–22. Note also that the common branch of the junction in the initial set may or may not be collinear with the input port 202 (FIGS. 18, 19 and 21). For example, the input port 202 (FIGS. 18, 19 and 21) could enter the antenna array housing from a side of the housing and then be connected to the common branch of the junction in the initial set via an H-plane bend.

As described above, the junction/bend sets alternate from sets of E-plane junctions and E-plane bends to sets of H-plane junctions and H-plane bends, and vice versa. Thus, if the set 0 has an H-plane junction and H-plane bends, then the set 1 has E-plane junctions and E-plane bends, the set 2 has H-plane junctions and H-plane bends, and so on. Each set of waveguide junctions and bends can generally be denoted as the set n, where n is an integer ranging from 0 to (N-1). In this manner, the total number of sets in the waveguide network is given by N, and a set n has $2^n$ junctions and $2^{n+1}$ corresponding bends. As mentioned, each of the separate branches in a junction of a particular set is connected to a first branch of a bend of that set.

Figure 24:
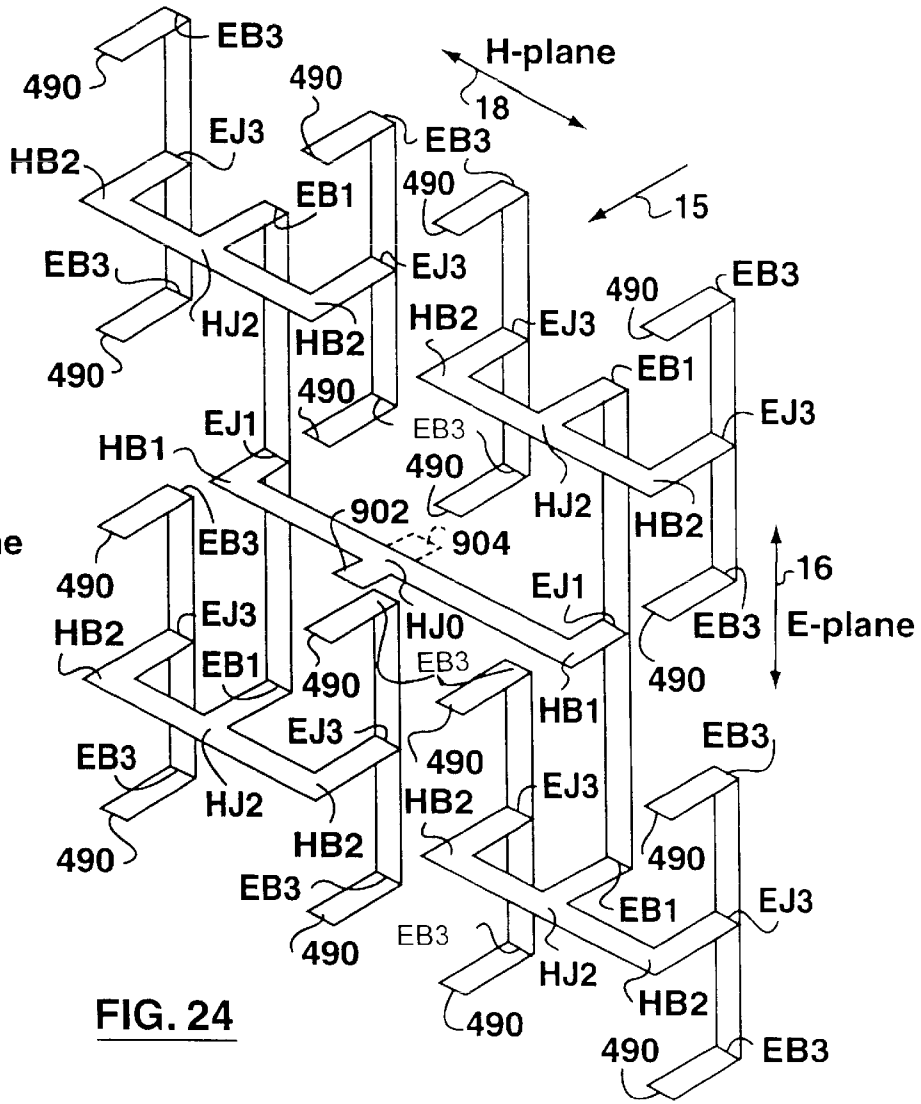
FIG. 24 illustrates a generalized four set waveguide network embodiment according to the invention.
Figure 23:
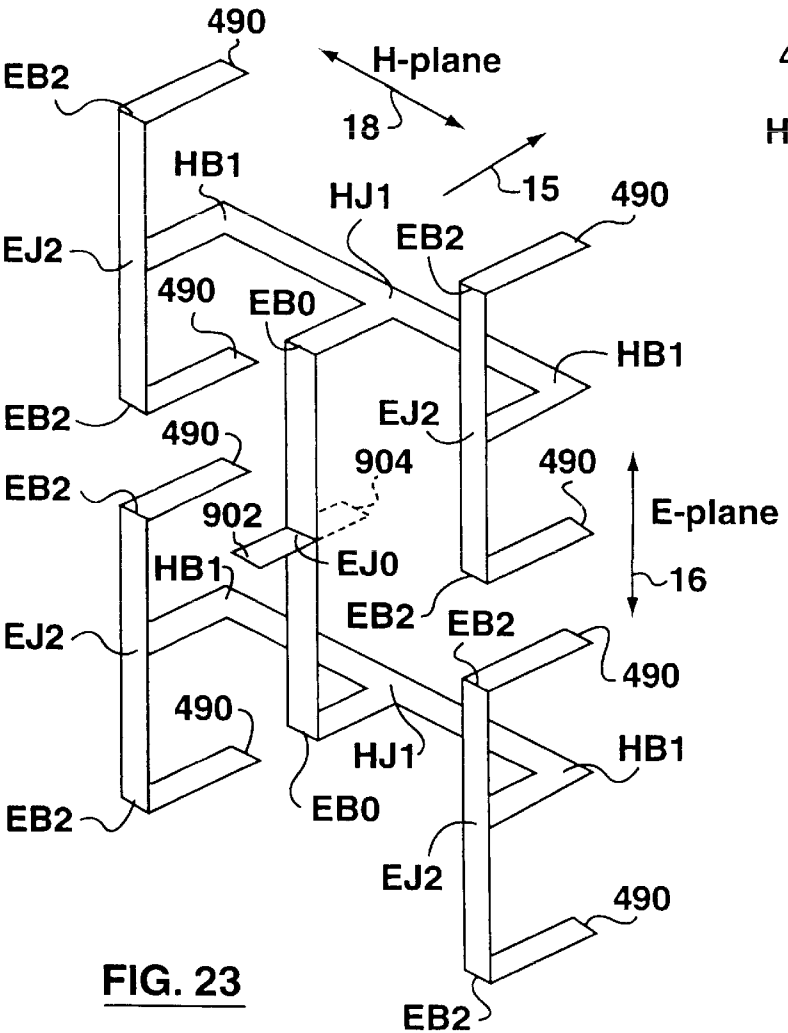
FIG. 23 illustrates a generalized three set waveguide network embodiment according to the invention.

In accordance with the present invention, the second branches of each of the bends in at least one set lead from their respective bends in the direction 15 in which the output ports are oriented (e.g the radiating direction for a radiating array), and the second branches of each of the bends in at least one other set, not including the last set, lead from their respective bends in a direction opposite to the direction 15. To illustrate, the arrangement or configuration of the waveguide network structure is more generally depicted by FIGS. 23 and 24. FIG. 23 shows a three set waveguide network embodiment, and FIG. 24 shows a four set waveguide network according to the invention. Preferably, the waveguide network of the present invention has at least three sets to enable the thickness of the waveguide network to be substantially reduced.

In FIG. 23, set 0 has an E-plane junction and bends, set 1 has H-plane junctions and bends, and set 2 has E-plane junctions and bends. The common branch 902 of the EJ0 junction in the initial set faces a direction opposite to the fixed direction (15) in which the output ports 490 are oriented. As illustrated at 904 in FIG. 23, the common branch of the EJ0 junction could also be oriented in the fixed direction 15. The second branches of the EB0 and EB2 bends lead from or out of the EB0 and EB2 bends, respectively in the fixed direction 15, and the second branches of the HB1 bends lead from or out of the HB1 bends in the direction opposite to the fixed direction 15.

In FIG. 24, a waveguide network is shown in which set 0 has an H-plane junction and bends, set 1 has E-plane junctions and bends, set 2 has H-plane junctions and bends, and set 3 has E-plane junctions and bends. In this embodiment, the common branch 902 of the junction in the initial set and the output ports 490 are oriented or face in the fixed direction 15. However, as illustrated at 904 in FIG. 23, the common branch of the EJ0 junction could also be oriented in a direction opposite to the fixed direction 15. The second branches of the HB0 and the HB2 bends lead from or out of their respective bends respectively in a direction opposite to the fixed direction 15. The second branches of the EB1 and the EB3 bends lead out of their respective bends in the fixed direction 15.

Preferably, the first and second branches of the E- and H-plane bends in the waveguide network are generally orthogonal to one another (i.e. they meet at or about an angle of 90°), of the separate branches of the E- and H-plane junctions in the network are generally collinear to one another, and of the common branches of the E- and H- plane junctions in the network intersect the two separate branches generally orthogonally.

A very beneficial aspect of the present invention is the ability to manufacture a small thickness waveguide network from a first thin piece containing all of the E-plane junctions and bends (e.g piece 300 in FIGS. 10 and 11) and a second piece containing all of the H-plane junctions and bends (e.g. piece 400 in FIGS. 10 and 11).

Preferably the bend direction in each set (i.e. the direction in which the second branches in that set lead) alternates with each successive set, with the possible exception of the last set whose bends may be oriented in the same direction as the previous to last set without any significant increase in thickness (as illustrated in the embodiment of FIG. 10–22). However as illustrated in the embodiments of FIGS. 23 and 24, the bends in the last set may bend in the opposite direction to the bends in the previous to last set. In either case, the thickness or profile of the waveguide fed antenna array is effectively minimized.

With an even number of sets, i.e. N is even, the waveguide network of the present invention can conveniently be used to feed an array of $2^N$ antenna elements arranged in a two dimensional $2^{N/2}$ by $2^{N/2}$ manner. For example, in the illustrated embodiment of FIGS. 10–22 with N equal to 6, the waveguide fed array 100 has sixty-four output ports 490 (or slots 502) arranged in an eight by eight manner. Similarly, with N equal to 8 (eight sets of waveguide junctions and bends), a waveguide fed antenna array with a two dimensional sixteen by sixteen configuration can be realized.

If the waveguide network has an odd number of sets, the antenna array will remain rectangular, but generally not square. For example, with N=3 as in FIG. 23, a four by two array of output ports 490 is achieved. In many applications a square two dimensions array of antenna elements is desirable, and so a waveguide with an even number of sets may be preferable. It is also possible to terminate, with a matched load, specific sections of the waveguide network, which could potentially result in a non-rectangular antenna array (e.g. triangular), however terminating sections in this manner will result in a loss of gain which is generally undesirable.

Furthermore, as described, the waveguide network according to the present invention can be very conveniently and cost effectively assembled from at least two separately built thin pieces, one containing all of the E-plane junctions and E-plane bends and the other containing all of the H-plane junctions and H-plane bends. When assembled these two pieces abut one another. If necessary, each of the "E-plane" and "H-plane" pieces may also abut another very thin piece on its opposite side, to complete the waveguide network by enclosing all the sections of waveguide network.

It should be noted that a finite difference time domain (FDTD) three dimensional structural simulator (FDTD 3D SS) can be used to design, test, and optimize the dimensions of the junction notches, posts, and the precise configuration of the walls in the waveguide junctions and bends. As mentioned, such waveguide features can be helpful in reducing losses in the waveguide fed array. The FDTD method is formulated using a central difference discretization of Maxwell's curl equation in four dimensions space-time, including non-uniform orthogonal algorithms. Simulations of this nature, as will be understood by those skilled in the art, require the setting of appropriate boundary conditions. One suitable simulator is the FDTD 3D SS, a PC-based user interface from Litva Antenna Enterprises Inc. in Hamilton, Ontario, Canada. Other similar simulation tools may also be used.

The waveguide network of the present invention can be used with waveguide antennas for point-to-point and point-to-multipoint communication systems in the millimeter wave, sub-millimeter wave, and other frequency bands. The invention is, for instance, suitable for use in the commercial frequency bands from 17.7 GHz to 19.7 GHz and from 21.4 GHz to 23.6 GHZ; bands that are commonly used for point-to-point communication systems. Without any loss of generality, the present invention may be used in a 38 GHz point-to-point PCS (Personal Communication Services) system, a 28 GHz point-to-multipoint LMDS (Local Multipoint Distribution Service) system for providing interactive video and high speed data access along with broadcast and telephony information, or a WLN (Wireless Local Network) for cellular telephones.

While preferred embodiments of the present invention have been described, the embodiments disclosed are exemplary and not restrictive, and the invention is intended to be defined by the appended claims.

I claim:

1. A waveguide network having:

(a) a first port;

(b) a plurality of second ports oriented in a first direction; and (c) a plurality of waveguide junctions and waveguide bends, each junction having a common branch and two separate branches, and each bend having a first branch and a second branch meeting at an angle, said junctions and bends being grouped into a plurality of sets with a particular set being denoted by n, n being an integer ranging from 0 to (N-1) and N representing the total number of sets and being an integer greater than or equal to three, the 0'th set being a first set, the n'th set having $2^n$ junctions and $2^{n+1}$ corresponding bends, each of the separate branches of each junction in a particular set being connected to the first branch of a bend in the same set, wherein (i) the plurality of sets comprise E-plane sets operatively coupled with H plane sets in an alternating fashion, each E-plane set comprising E-plane junctions and E plane bends, and each H-plane set comprising H-plane junctions and H-plane bends;

(ii) the common branch of the junction in the first set is connected to said first port;

(iii) the second branch of each of the bends in the n'th set, other than the last set, is connected to the common branch of a junction in the n+1)'th set, and the second branch of each of the bends in the last set is connected to one of said plurality of second ports; and (iv) the second branches of each of the bends in at least one set extend in the first direction, and the second branches of each of the bends in at least one other set, not including the last set, extend in a direction opposite to said first direction.

2. A waveguide network according to claim 1 wherein the first and second branches of each waveguide bend meet at an angle substantially equal to 90°, the separate branches of the waveguide junctions are generally collinear to one another, and the common branches of each waveguide junction intersects the two separate branches of that junction generally orthogonally.

3. A waveguide network according to claim 1 wherein the second branches of each bend in each set, other than the first set, extend in a direction opposite to the second branches of each bend in the previous set.

4. A waveguide network according to claim 1 wherein the second branches of each bend in each set, other than the first set and the last set, extend in a direction opposite to the second branches of each bend in the previous set.

5. A waveguide network according to claim 4 comprising a plurality of separate pieces including a first piece containing all of the E-plane junctions and E-plane bends and a second piece containing all of the H-plane junctions and H-plane bends, the first and second pieces abutting one another when the waveguide network is assembled.

6. A waveguide network according to claim 4 wherein the plurality of second ports are arranged in a two dimensional rectangular array.

7. A waveguide network according to claim 6 wherein each second port is connected to a respective antenna element.

8. A waveguide network according to claim 7 wherein N is even and the array is square.

9. A waveguide network according to claim 8 wherein each set in which n is zero or n is even is a set of E-plane junctions and E-plane bends, and each set in which n is odd is a set of H-plane junctions and H-plane bends.

10. A waveguide network according to claim 8 wherein each set in which n is zero or n is even is a set of H-plane junctions and H-plane bends, and each set in which n is odd is a set of E-plane junctions and E-plane bends.

11. A waveguide network according to claim 8 comprising a plurality of separate pieces including a first piece containing all of the E-plane junctions and E-plane bends and a second piece containing all of the H-plane junctions and H-plane bends, the first and second pieces abutting one another when the waveguide network is assembled.

12. A waveguide network according to claim 1 wherein said waveguide network has a rectangular cross-section defined by a first length along an E-plane direction and a second length along an H-plane direction, said second length being greater than said first length.

13. A waveguide network according to claim 12 wherein said second length is greater than or equal to twice said first length.

14. Use of a waveguide network according to claim 12 for propagating an electromagnetic signal therewithin, said electromagnetic signal having a wavelength which is greater than said second length and greater than twice said first length, such that the electromagnetic signal propagates in a $TE_{10}$ propagation mode.

15. A waveguide network for connecting a first port to a plurality of second ports, the second ports being oriented in a first direction, the waveguide network comprising at least three successive sets of junctions and bends including a first set connected to said first port, a last set connected to said plurality of second ports and at least another set operatively coupled between the first set and the second set, the junctions and bends in each set being one of (i) E-plane junctions and E-plane bends and (ii) H-plane junctions and H-plane bends, and successive sets alternating between a set of E-plane junctions and E-plane bends and a set of H-plane junctions and H-plane bends, wherein the waveguide bends in at least one set extend in the first direction, and the waveguide bends in at least one other set, not including the last set, extend in a direction opposite to said first direction.

16. A waveguide network according to claim 15 wherein each bend in each set, other than the first set and the last set, extend in a direction opposite to the direction in which the bends in the previous set extend.

17. A waveguide network according to claim 16 wherein said waveguide network has a rectangular cross-section defined by a first length along an E-plane direction and a second length along an H-plane direction, said second length being greater than said first length.

18. A waveguide network according to claim 16 comprising a plurality of separate pieces including a first piece containing all of the E-plane junctions and E-plane bends and a second piece containing all of the H-plane junctions and H-plane bends, the first and second pieces abutting one another when the waveguide network is assembled.

19. A waveguide network according to claim 16 wherein the plurality of second ports are arranged in a two dimensional rectangular array and each second port is connected to a respective antenna element.

20. A waveguide network according to claim 19 having an even number of sets of junctions and bends and wherein said array is square.

* * * * *

UNITED STATES PATENT AND TRADEMARK OFFICE

CERTIFICATE OF CORRECTION

PATENT NO. : 6,563,398 B1
DATED : May 13, 2003
INVENTOR(S) : Chen Wu

It is certified that error appears in the above-identified patent and that said Letters Patent is hereby corrected as shown below:

Column 3,
Line 29, insert -- preferably -- before "comprise".
Line 30, delete "all of the".
Line 32, delete "all of the".
Line 50, change "extend" to -- extends --.

Column 4,
Line 53, change "then" to -- than --.
Line 55, change "ends of the" to -- ended --.
Line 60, insert -- Thus -- before "In", and change "In" to -- in --.
Line 65, change "parallel to" to -- along --.

Column 4, line 66 - Column 5, line 1,
Delete "the arrow 15 is parallel to the direction in which the slots 12 are oriented (i.e. the direction in which they face)".

Column 6,
Line 6, change "the" to -- The --.
Line 37, change "a≥2" to -- a≥2b --.

Column 7,
Line 56, change "equisdistant" to -- equidistant --.

Column 8,
Line 29, delete "an orientation of".

Column 9,
Line 22, change "210" to -- 310 --.
Line 60, change "11" to -- 12 --.
Line 61, change "II-plane" to -- H-plane --.

Column 12,
Line 55, change "EB4" to -- EB2 --.

Column 13,
Line 28, change "show" to -- shows --.
Line 52, change "H-plant" to -- H-plane --.

UNITED STATES PATENT AND TRADEMARK OFFICE

CERTIFICATE OF CORRECTION

PATENT NO. : 6,563,398 B1
DATED : May 13, 2003
INVENTOR(S) : Chen Wu

It is certified that error appears in the above-identified patent and that said Letters Patent is hereby corrected as shown below:

Column 14,
Line 37, delete “)” after “520”.
Line 62, change “sections” to -- section --.

Column 15,
Line 19, change “to” to -- and --.
Line 42, change “direction” to -- directions --.

Column 16,
Lines 23-24, delete “and EB2” and “, respectively”.

Column 17,
Line 14, change “dimensions” to -- dimensional --.
Line 41, change “equation” to -- equations --, and change “dimensions” to -- dimensional --.
Line 55, change “GHZ” to -- GHz --.

Column 18,
Line 20, change “H plane” to -- H-plane --.
Line 22, change “E plane” to -- E-plane --.
Line 28, insert -- (-- before “n”.

Column 19,
Line 33, change “between the first set and the second set” to -- to a preceding set and a following set --.

Signed and Sealed this

Thirtieth Day of May, 2006

JON W. DUDAS
*Director of the United States Patent and Trademark Office*